US011267671B2

(12) United States Patent
Haraguchi et al.

(10) Patent No.: US 11,267,671 B2
(45) Date of Patent: Mar. 8, 2022

(54) SHEET PROCESSING APPARATUS AND IMAGE FORMING SYSTEM INCORPORATING THE SAME

(71) Applicants: Yohsuke Haraguchi, Kanagawa (JP); Shinji Asami, Tokyo (JP); Tomohiro Furuhashi, Kanagawa (JP); Michitaka Suzuki, Kanagawa (JP); Tomomichi Hoshino, Kanagawa (JP); Fumiharu Yoneyama, Kanagawa (JP); Akira Kunieda, Tokyo (JP); Takuya Morinaga, Tokyo (JP); Makoto Hidaka, Tokyo (JP); Koki Sakano, Kanagawa (JP)

(72) Inventors: Yohsuke Haraguchi, Kanagawa (JP); Shinji Asami, Tokyo (JP); Tomohiro Furuhashi, Kanagawa (JP); Michitaka Suzuki, Kanagawa (JP); Tomomichi Hoshino, Kanagawa (JP); Fumiharu Yoneyama, Kanagawa (JP); Akira Kunieda, Tokyo (JP); Takuya Morinaga, Tokyo (JP); Makoto Hidaka, Tokyo (JP); Koki Sakano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 139 days.

(21) Appl. No.: 16/276,823

(22) Filed: Feb. 15, 2019

(65) Prior Publication Data

US 2019/0367317 A1 Dec. 5, 2019

(30) Foreign Application Priority Data

Mar. 19, 2018 (JP) ..... JP2018-050382

(51) Int. Cl.
*B65H 45/16* (2006.01)
*B65H 45/04* (2006.01)

(52) U.S. Cl.
CPC ..... *B65H 45/167* (2013.01); *B65H 45/04* (2013.01); *B65H 45/165* (2013.01); *B65H 45/168* (2013.01)

(58) Field of Classification Search
CPC .... B65H 45/167; B65H 45/04; B65H 45/165; B65H 45/168
See application file for complete search history.

(56) References Cited

U.S. PATENT DOCUMENTS 3,240,487 A * 3/1966 Templeton ..... B65H 9/20 271/228
5,734,404 A * 3/1998 Komuro ..... B41J 11/0035 271/272

(Continued)

FOREIGN PATENT DOCUMENTS

JP 2003-063698 3/2003
JP 2012-101938 A 5/2012

(Continued)

OTHER PUBLICATIONS

Extended European Search Report dated Aug. 23, 2019 issued in corresponding European Application No. 19157530.7.

(Continued)

*Primary Examiner* — Nathaniel C Chukwurah
*Assistant Examiner* — Lucas E. A. Palmer
(74) *Attorney, Agent, or Firm* — Harness, Dickey & Pierce, P.L.C.

(57) ABSTRACT

A sheet processing apparatus includes a roller pair configured to convey a sheet, a sheet bundle conveyer configured to convey a sheet bundle to the roller pair, and circuitry configured to cause the sheet bundle conveyer to contact (Continued)

leading edges of sheets of the sheet bundle to the roller pair and cause the roller pair to rotate in reverse to align the leading edges of the sheets of the sheet bundle.

19 Claims, 16 Drawing Sheets

(56) References Cited

U.S. PATENT DOCUMENTS 5,967,506 A * 10/1999 Miki ..... B65H 9/06 271/10.13
6,332,606 B1 * 12/2001 Seki ..... B42C 1/12 270/58.08
6,338,481 B1 * 1/2002 Maruchi ..... B65H 29/70 271/188
6,554,216 B1 * 4/2003 Escobedo ..... B41J 11/46 198/624
7,467,793 B2 * 12/2008 Tanabe ..... B65H 5/062 271/227
8,123,215 B2 * 2/2012 Kanda ..... B65H 31/3072 271/244
8,950,747 B2 * 2/2015 Kikuchi ..... B65H 7/02 271/242
8,955,839 B2 * 2/2015 Oyama ..... B65H 9/006 271/242
9,448,523 B2 * 9/2016 Beck ..... B65H 7/08
2003/0034604 A1 * 2/2003 Shida ..... B65H 37/04 271/3.01
2004/0032074 A1 * 2/2004 Park ..... B65H 5/06 271/4.01
2005/0067777 A1 * 3/2005 IIda ..... B65H 29/60 271/303
2006/0071414 A1 * 4/2006 Kawatsu ..... B65H 9/06 271/225
2006/0261544 A1 * 11/2006 Tamura ..... B65H 39/10 271/303
2007/0045924 A1 * 3/2007 Kamiya ..... B65H 31/3027 270/58.1
2007/0138726 A1 * 6/2007 Tamura ..... G03G 15/6582 270/37
2008/0224386 A1 * 9/2008 Kunieda ..... G03G 15/6538 271/226
2008/0258373 A1 * 10/2008 Wakabayashi ..... B65H 29/14 270/58.17
2009/0088308 A1 * 4/2009 Obuchi ..... G03D 13/08 493/186
2012/0119435 A1 * 5/2012 Kaneko ..... B65H 31/34 271/253
2012/0267846 A1 10/2012 Nakada et al.
2014/0061990 A1 * 3/2014 Gamo ..... B65H 31/3027 270/1.01
2014/0203486 A1 7/2014 Sugiyama et al.
2014/0203487 A1 7/2014 Hoshino et al.
2014/0203488 A1 7/2014 Hidaka et al.
2014/0206516 A1 7/2014 Hata et al.
2014/0206517 A1 7/2014 Kikuchi et al.
2014/0206518 A1 7/2014 Hidaka et al.
2014/0206519 A1 7/2014 Hoshino et al.
2014/0213425 A1 7/2014 Sugiyama et al.
2014/0336031 A1 11/2014 Suzuki et al.
2014/0364295 A1 12/2014 Watanabe et al.
2015/0031520 A1 1/2015 Nakada et al.
2015/0225201 A1 8/2015 Watanabe et al.
2015/0266697 A1 9/2015 Saito et al.
2016/0060072 A1 3/2016 Watanabe et al.
2016/0068359 A1 3/2016 Suzuki et al.
2016/0114999 A1 4/2016 Suzuki et al.
2016/0115000 A1 4/2016 Sugiyama et al.
2018/0201466 A1 7/2018 Saito et al.
2018/0236744 A1 8/2018 Suzuki et al.
2018/0257900 A1 9/2018 Suzuki et al.

FOREIGN PATENT DOCUMENTS

JP 2012-224433 11/2012
JP 2014-125312 7/2014

OTHER PUBLICATIONS

Office Action dated Nov. 19, 2021 issued in corresponding Japanese Patent Application No. 2018-050382.

* cited by examiner

SHEET PROCESSING APPARATUS AND IMAGE FORMING SYSTEM INCORPORATING THE SAME

CROSS-REFERENCE TO RELATED APPLICATIONS

This patent application is based on and claims priority pursuant to 35 U.S.C. § 119 to Japanese Patent Application No. 2018-050382, filed on Mar. 19, 2018, in the Japanese Patent Office, the entire disclosure of which is hereby incorporated by reference herein.

BACKGROUND

Technical Field

This disclosure relates to a sheet processing apparatus and an image forming system incorporating the sheet processing apparatus.

Background Art

A sheet processing apparatus includes a conveyance roller pair and a sheet bundle conveyance device that conveys a sheet bundle to the conveyance roller pair, causes a leading-edge of the sheet bundle to contact the conveyance roller pair, and performs a leading-edge alignment procedure.

SUMMARY

This specification describes an improved sheet processing apparatus that includes a roller pair configured to convey a sheet, a sheet bundle conveyer configured to convey a sheet bundle to the roller pair, and circuitry configured to cause the sheet bundle conveyer to contact leading edges of sheets of the sheet bundle to the roller pair and cause the roller pair to rotate in reverse to align the leading edges of the sheets of the sheet bundle.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
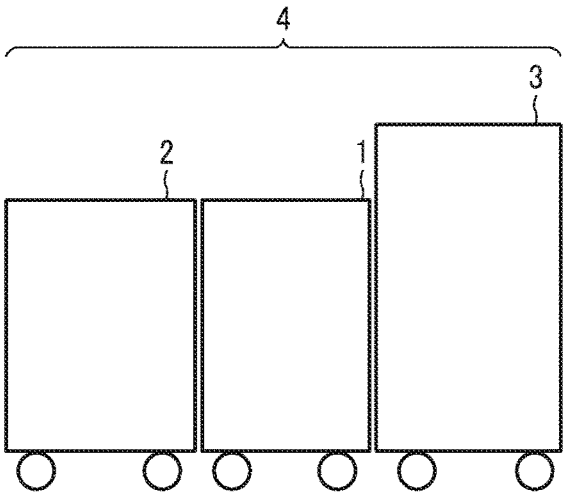
FIG. 1 is a schematic diagram illustrating a system configuration of an image forming system including an image forming apparatus and a plurality of sheet processing apparatuses according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements having the same function or shape and redundant descriptions thereof are omitted below.

FIG. 1 is a schematic diagram illustrating a system configuration of an image forming system 4 according to an embodiment of the present disclosure, including an image forming apparatus and a plurality of sheet processing apparatuses. The image forming system 4 in the present embodiment includes a folding apparatus 1 and a post-processing apparatus 2, each of which serves as the sheet processing apparatus, provided in this order at later stages of the image forming apparatus 3, as illustrated in FIG. 1.

The image forming apparatus 3 forms an image on a sheet based on image data that is input to the image forming apparatus 3 or obtained by scanning. The image forming apparatus 3 may be, for instance, a copier, a printer, a facsimile machine, or a multifunction peripheral having at least two functions of the foregoing machines. The image forming apparatus 3 may use any known image forming method, such as electrophotography or droplet discharge. The image forming apparatus 3 in the present embodiment is a copier using the electrophotography.

Examples of the post-processing apparatus 2 include a punch apparatus that punches a hole in the sheet, a sheet binding apparatus in which a stapler or the like binds sheets and make a sheet bundle, and a sorter that sorts and ejects a sheet on which an image formed into each of a plurality of ejection trays.

Figure 2:
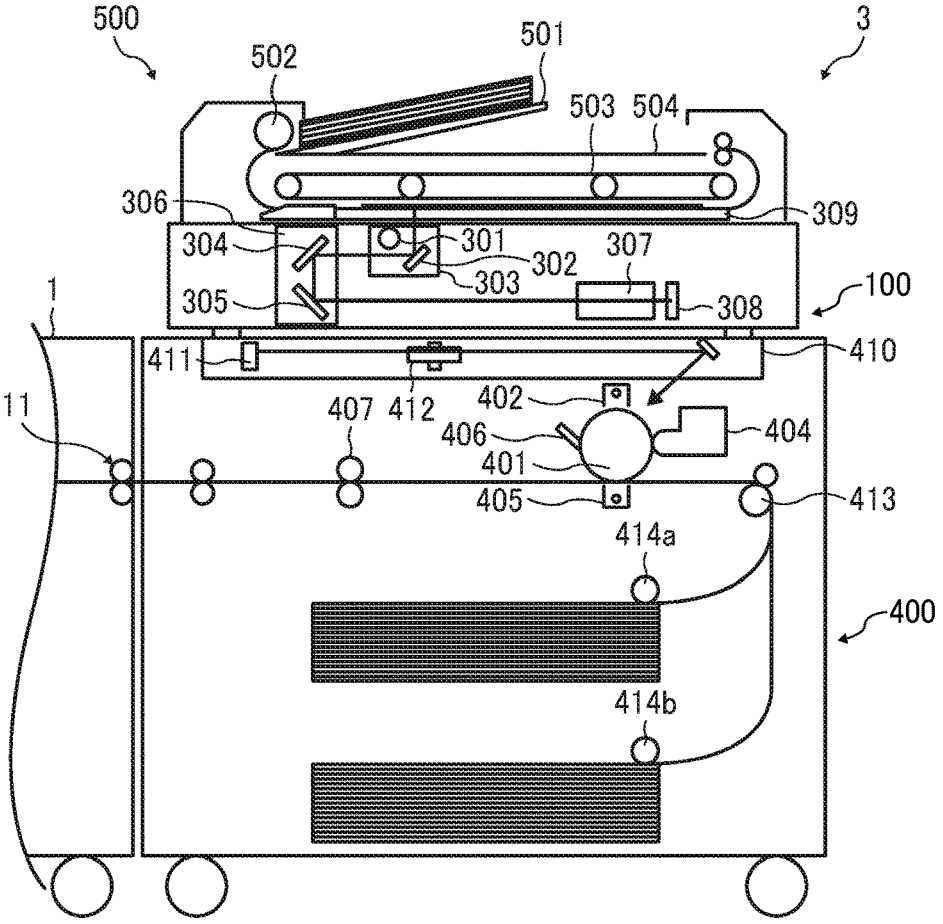
FIG. 2 is a schematic configuration diagram of an image forming apparatus provided in the image forming system of FIG. 1.

FIG. 2 is a schematic configuration diagram of the image forming apparatus 3 provided in the image forming system 4 according to the present embodiment.

In an image forming apparatus main body 400, feeding cassettes to store sheets serving as recording media are disposed below an image forming section. After the sheet stored in the feeding cassettes is fed by the feeding roller 414*a* or 414*b*, the sheet is conveyed upward along a predetermined conveyance path. Then the sheet reaches a registration roller pair 413.

The image forming section includes a photoconductor drum 401 as an image bearer, a charger 402, an exposure device 410, a developing device 404, a transfer device 405, and a cleaner 406.

The charger 402 uniformly charges a surface of the photoconductor drum 401. The exposure device 410 serving as a latent image forming device forms an electrostatic latent image on the photoconductor drum 401 based on image data read by a scanner 100. The developing device 404 adheres toner to the electrostatic latent image formed on the photoconductor drum 401 to form a visible image as a toner image. The transfer device 405 transfers the toner image from the photoconductor drum 401 onto the sheet. The cleaner 406 removes toner remaining on the photoconductor drum 401 after the transfer.

On the downstream side of the image forming section in a sheet conveyance direction, a fixing device 407 to fix the toner image on the sheet is disposed.

The exposure device 410 includes a laser unit 411 to emit a laser beam based on the image data under a control of a controller and a polygon mirror 412 to scan the laser beam from the laser unit 411 in a rotation axis direction of the photoconductor drum 401 which is called a main scanning direction.

An automatic document feeder 500 is mounted on the scanner 100. The automatic document feeder 500 includes a platen 501, a separation and feed roller 502, an original conveyor belt 503, and an original ejection tray 504.

When the automatic document feeder 500 receives an instruction to start scanning originals placed on the platen 501, the separation and feed roller 502 feeds the originals one by one from the platen 501 to the original conveyor belt 503. The original conveyor belt 503 moves the originals onto a platen glass 309 on which each of the originals temporally stops.

Then, the scanner 100 reads the image data of the original temporarily stopped on the platen glass 309. Thereafter, the original conveyor belt 503 resumes conveyance of the original to eject the original onto the original ejection tray 504.

A more detailed description is now provided of an image reading operation and an image forming operation.

In addition to the platen glass 309, the scanner 100 includes a first carrier 303, a light source 301 and a mirror 302 provided on the first carrier 303, a second carrier 306, mirrors 304 and 305 provided on the second carrier 306, a lens 307, and a charge coupled device (CCD) 308. The light source 301 is lighted when the automatic document feeder 500 conveys the original onto the platen glass 309 or when a user places an original on the platen glass 309 and directs the image forming apparatus to start copying via an operation panel. In the meantime, the first carrier 303 and the second carriers 306 move along a guide rail.

The light source 301 emits light to the original positioned on the platen glass 309. Reflected light from the original is guided to the CCD 308 via the mirror 302, the mirrors 304 and 305, and the lens 307. The CCD 308 receives the reflected light and reads the image data of the original. The image data is converted from analog data to digital data by an analog-to-digital converter. The digital data is sent from a data output unit to the controller in the image forming apparatus main body 400.

On the other hand, the image forming apparatus main body 400 starts to drive the photoconductor drum 401, and after a rotation speed of the photoconductor drum 401 reaches a predetermined speed, the charger 402 uniformly charges the surface of the photoconductor drum 401. The exposure device 410 forms the electrostatic latent image on the charged surface of the photoconductor drum 401 based on the image data read by the scanner 100.

Thereafter, the developing device 404 develops the electrostatic latent image on the surface of the photoconductor drum 401 into a toner image. In the meantime, the feeding roller 414*a* or 414*b* feeds the sheet stored in the feeding cassette, and the registration roller pair 413 temporarily stops the sheet.

The registration roller pair 413 feeds the sheet to a transfer portion opposed to the transfer device 405 when a leading edge of the toner image formed on the surface of the photoconductor drum 401 reaches the transfer portion. While the sheet passes through the transfer portion, a transfer electric field transfers the toner image formed on the surface of the photoconductor drum 401 onto the sheet.

The sheet on which the toner image is transferred is conveyed to the fixing device 407, subjected to a fixing process by the fixing device 407, and then ejected to the folding apparatus 1 at the subsequent stage. The cleaner 406 removes residual toner which is not transferred onto the sheet at the transfer portion and remains on the surface of the photoconductor drum 401.

Figure 3:
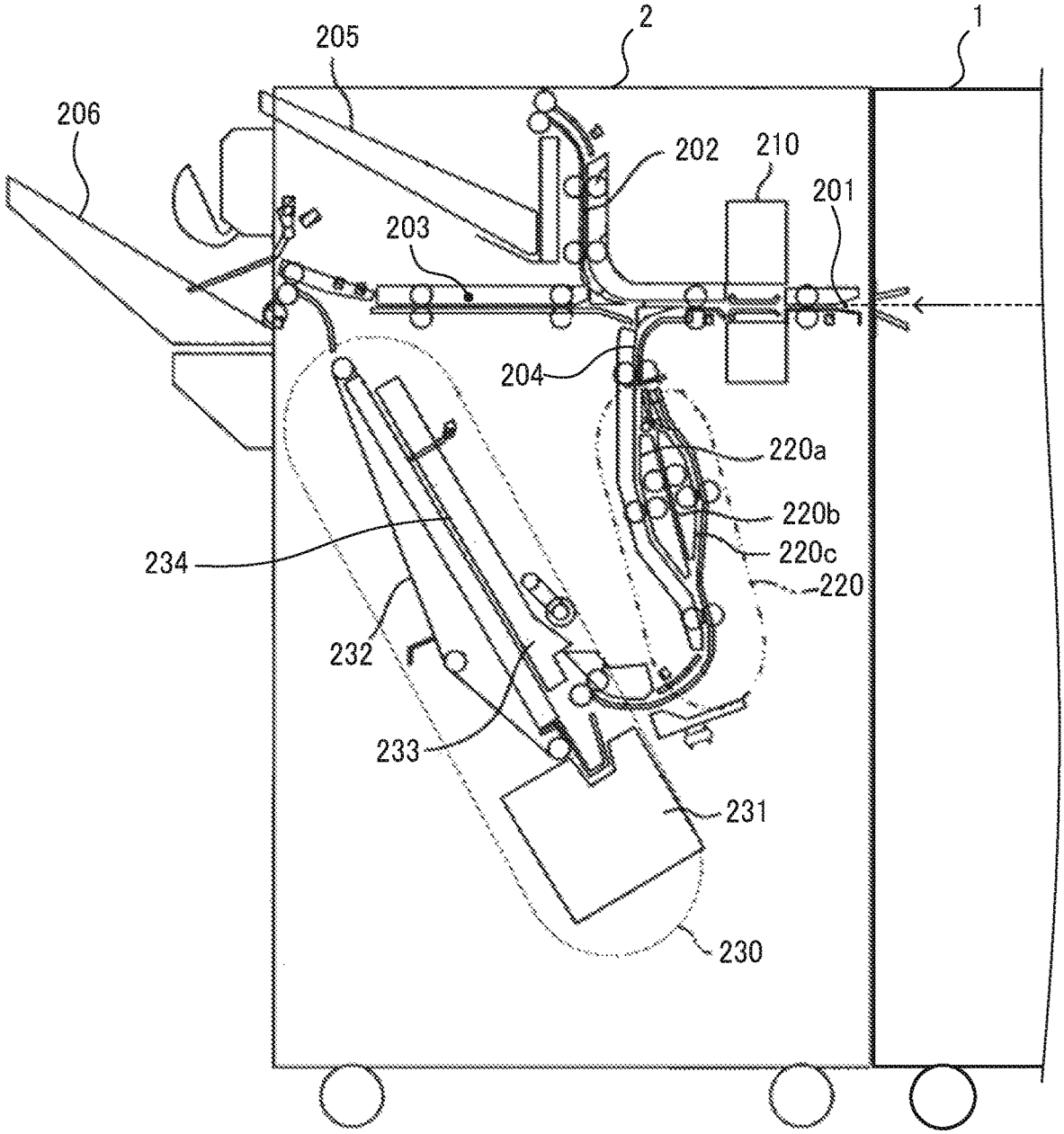
FIG. 3 is a schematic configuration diagram of a post-processing apparatus provided in the image forming system of FIG. 1.

FIG. 3 is a schematic configuration diagram of the post-processing apparatus 2 provided in the image forming system 4 according to the embodiment.

The post-processing apparatus 2 includes an introduction path 201 to receive the sheet from the folding apparatus 1 and three paths diverging from the introduction path 201, that is, a first ejection path 202 to eject the sheet to an upper tray 205, a second ejection path 203 to eject the sheet to a shift tray 206, and a conveyance path 204 to convey the sheet to a sheet binding device 230. On the introduction path 201, a punching device 210 is disposed to puncture a punch hole in the sheet. The punching device 210 punctures the punch hole at a predetermined position in a folded sheet, a folded sheet bundle, and a single sheet that has been conveyed without being folded, which are ejected from the folding apparatus 1.

On the conveyance path 204, an overlay device 220 is disposed. The overlay device 220 includes three conveyance paths 220*a*, 220*b*, and 220*c*. Sorting the sheets to each conveyance path and temporarily waiting on each conveyance path allows up to three sheets to be overlaid and conveyed.

The sheet binding device 230 includes a processing tray 233, a jogger fence 234 to align a plurality of sheets in the processing tray 233, a stapler unit 231 to perform binding processing on the sheet bundle in the processing tray 233, and a conveyance belt 232 to convey the sheet bundle subjected to binding processing toward the shift tray 206.

When the predetermined number of sheets which are folded or not folded is conveyed to the processing tray 233, the jogger fence 234 performs the alignment processing on the sheet bundle in the processing tray 233. Then, after the stapler unit 231 performs the binding processing on the sheet bundle in the processing tray 233, the conveyance belt 232 conveys the bound sheet bundle, and the bound sheet bundle is ejected to the shift tray 206.

Figure 4:
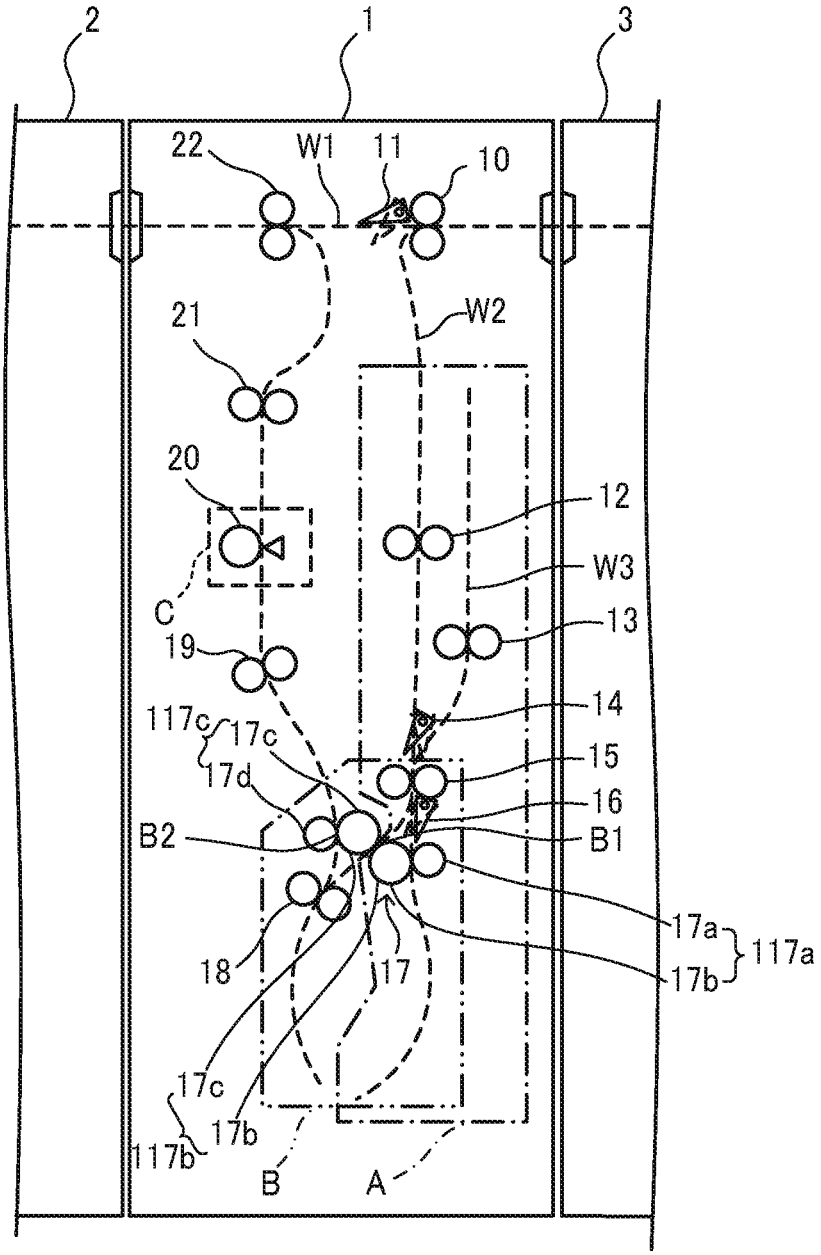
FIG. 4 is a schematic configuration diagram of a folding apparatus provided in the image forming system of FIG. 1.

FIG. 4 is a schematic configuration diagram of a folding apparatus 1 provided in the image forming system 4 according to the embodiment.

As illustrated in FIG. 4, the folding apparatus 1 includes an entry roller pair 10 to convey the sheet received from the image forming apparatus 3. On the downstream side from the entry roller pair 10, the sheet conveyance path is divided into a folding processing conveyance path W2 to convey the sheet and perform the folding processing and a through conveyance path W1 to convey the sheet without the folding processing. A first bifurcating claw 11 is disposed at a fork between the folding processing conveyance path W2 and the through conveyance path W1. The first bifurcating claw 11 guides the sheet to the through conveyance path W1 or the folding processing conveyance path W2.

The folding processing conveyance path W2 includes an overlay section A to overlap a plurality of sheets, a folding section B to fold one sheet or sheets overlaid in the overlay section A, and an additional folding section C in which the folded sheet is additionally folded.

The overlay section A includes a registration roller pair 15, a first conveyance roller pair 117*a* including a first pressing roller 17*a* in a folding mechanism 17 described later and a first folding roller 17*b*, and a conveyance roller pair 12 to convey the sheet toward the registration roller pair 15. The overlay section A also includes a switchback conveyance path W3 that branches from the folding processing conveyance path W2 between the conveyance roller pair 12 and the registration roller pair 15 and a switchback conveying roller pair 13 disposed in the switchback conveyance path W3. The registration roller pair 15 conveys the sheet in a reverse direction to the switchback conveyance path W3. The overlay section A also includes a second bifurcating claw 14 disposed at a fork between the switchback conveyance path W3 and the folding processing conveyance path W2 from the conveyance roller pair 12 to the registration roller pair 15 to guide the sheet conveyed in the reverse direction toward the switchback conveyance path W3.

The folding section B is disposed downstream of the overlay section A. The folding section B includes the registration roller pair 15, the folding mechanism 17, and a second conveyance roller pair 18. The folding mechanism 17 includes the first folding roller 17*b*, the first pressing roller 17*a* which contacts the first folding roller 17*b* to switch back the sheet, a second folding roller 17*c* which contacts the first folding roller 17*b* to form a first folding nip B1, and a second pressing roller 17*d* which contacts the second folding roller 17*c* to form a second folding nip B2. The driving force is transmitted to one of the plurality of rollers included in the folding mechanism 17, and the other rollers are driven to rotate.

A third bifurcating claw 16 is disposed downstream of the registration roller pair 15 to guide the sheet to the nip between the first folding roller 17*b* and the first pressing roller 17*a* or the first folding nip B1.

On the downstream side of the folding section B, the additional folding section C is disposed. The additional folding section C includes an additional folding roller 20. The additional folding roller 20 has a pressing convex portion, and the pressing convex portion presses the folded portion of the sheet, and the folded portion of the sheet is additionally folded.

Figure 5:
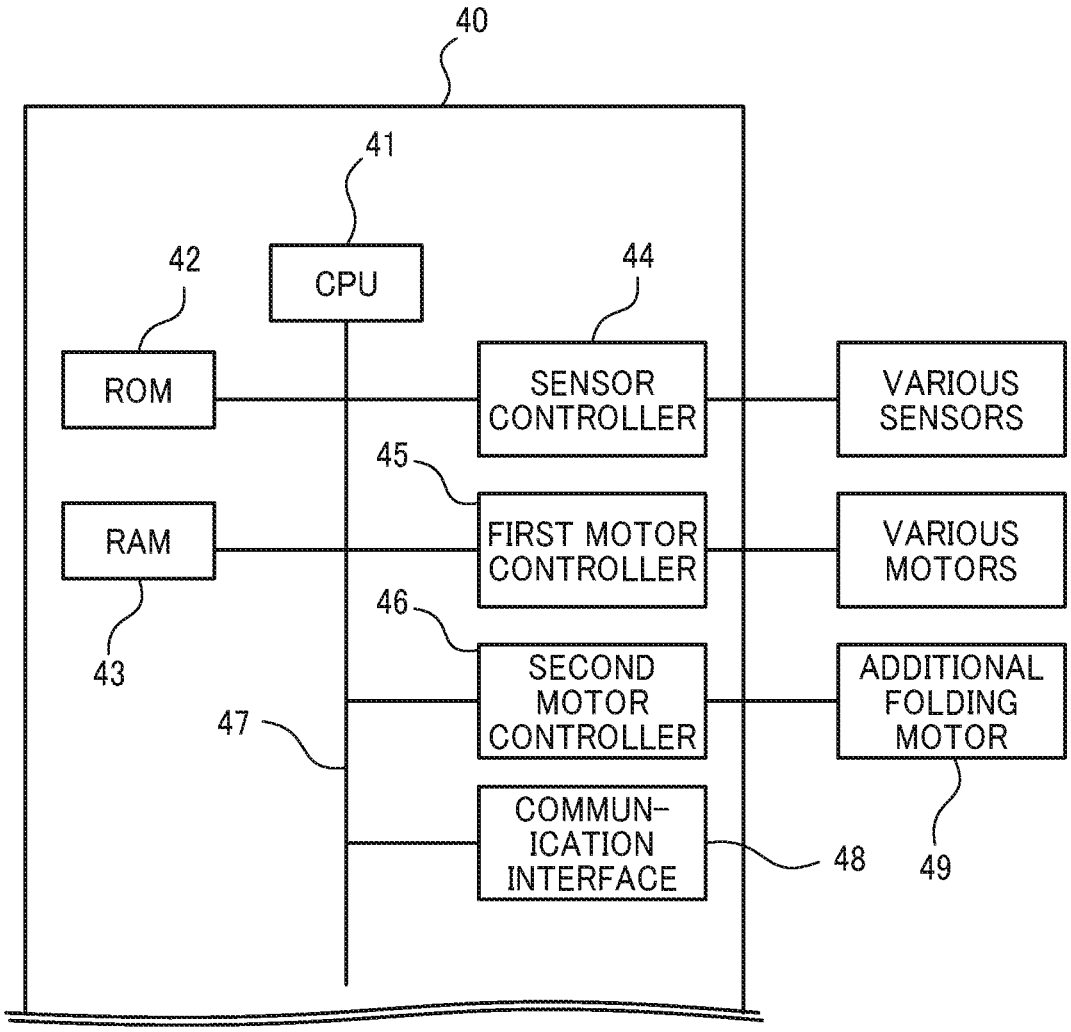
FIG. 5 is a block diagram of an example of a control circuit to control the folding apparatus of the image forming system of FIG. 1.

FIG. 5 is a block diagram of an example of a control circuit to control the folding apparatus 1 in the image forming system 4.

The controller 40 to control the folding apparatus 1 includes a Central Processing Unit (CPU) 41, a Read Only Memory (ROM) 42, a Random Access Memory (RAM) 43, a sensor controller 44 to control various sensors such as a paper detection sensor disposed in the folding apparatus 1, a first motor controller 45 to control a plurality of conveyance motors which convey the sheet in the folding apparatus 1, a second motor controller 46 to control the additional folding motor 49 that drives the additional folding roller 20, and a communication interface 48.

These components are mutually electrically coupled via a bus line 47 such as an address bus or a data bus. The communication interface 48 communicates with the image forming apparatus 3 and the post-processing apparatus 2 in FIG. 1 and exchanges data necessary for control. The ROM 42 stores data and programs executed by the CPU 41. The CPU 41 executes a computer readable program stored in the ROM 42 to control the folding apparatus 1. The RAM 43 temporarily stores data when the CPU 41 executes the program.

FIGS. 6A to 6F are explanatory diagrams illustrating the sheet overlay operation executed by the overlay section A of the folding apparatus 1.

Figure 6A:
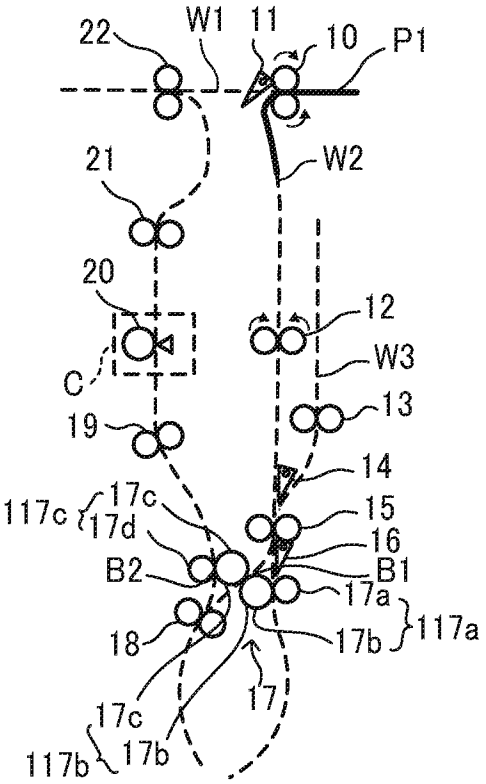
FIGS. 6A to 6F are explanatory diagrams illustrating a sheet overlay operation executed by an overlay device of the folding apparatus.

As illustrated in FIG. 6A, the entry roller pair 10 conveys the first sheet P1 to the folding processing conveyance path W2. A leading edge of the first sheet P1 conveyed to the folding processing conveyance path W2 contacts the registration roller pair 15 to correct the skew of the preceding sheet. However, this skew correction may not be performed.

Figure 6B:
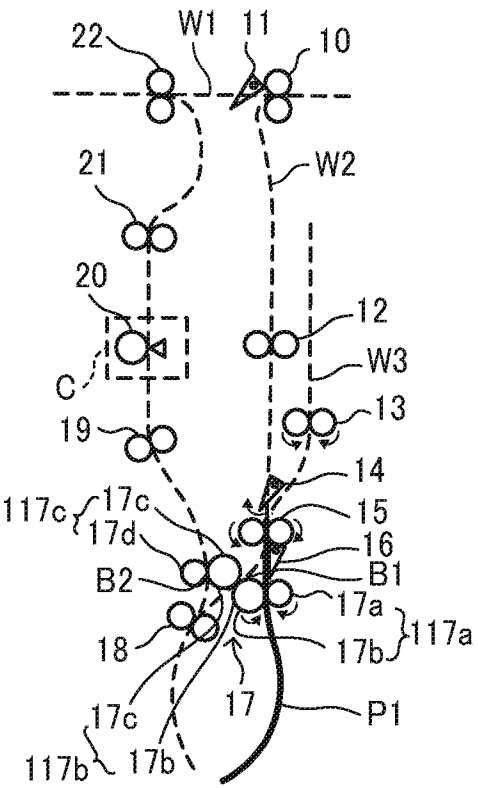
Figure 6C:
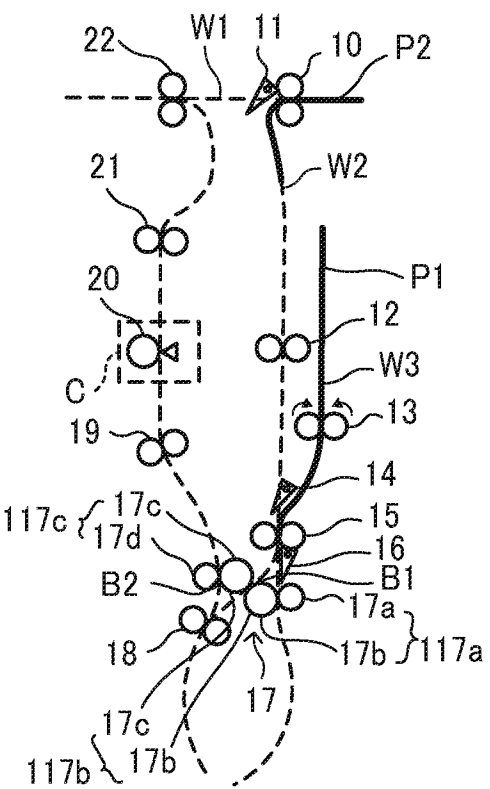

Next, the registration roller pair 15 and the first conveyance roller pair 117*a* serving as a first conveyance member including the first pressing roller 17*a* and the first folding roller 17*b* conveys the first sheet P1 in a predetermined direction which is called a regular direction. Next, when the trailing edge of the first sheet P1 passes through the fork between the folding processing conveyance path W2 and the switchback conveyance path W3, the conveyance of the first sheet P1 is stopped. Next, the second bifurcating claw 14 pivots in the clockwise direction in FIG. 6B, and the posture of the second bifurcating claw 14 is switched to guide the sheet P1 to the switchback conveyance path W3. Next, as illustrated in FIG. 6B, the registration roller pair 15, the first conveyance roller pair 117*a*, and the switchback conveying roller pair 13 rotate in reverse. This reverse rotation conveys the first sheet P1 in a reverse direction that is a direction opposite to the predetermined direction, and the first sheet P1 is conveyed to the switchback conveyance path W3. When the leading edge of the first sheet P1 in the regular direction is conveyed to the switchback conveyance path W3, the switchback conveying roller pair 13 stops the conveyance of the first sheet P1. After stopping the conveyance of the first sheet P1, as illustrated in FIG. 6C, the switchback conveying roller pair 13 conveys the first sheet P1 in the regular direction, strikes the leading edge of the first sheet P1 against the registration roller pair 15 to correct the skew, and puts the first sheet P1 on standby.

In this way, by conveying the preceding first sheet P1 to the switchback conveyance path W3 and withdrawing the preceding sheet P1 from the folding processing conveyance path W2, the preceding sheet P1 does not obstruct the conveyance of a following second sheet P2, thereby enabling smooth conveyances of the following second sheet P2.

Figure 6D:
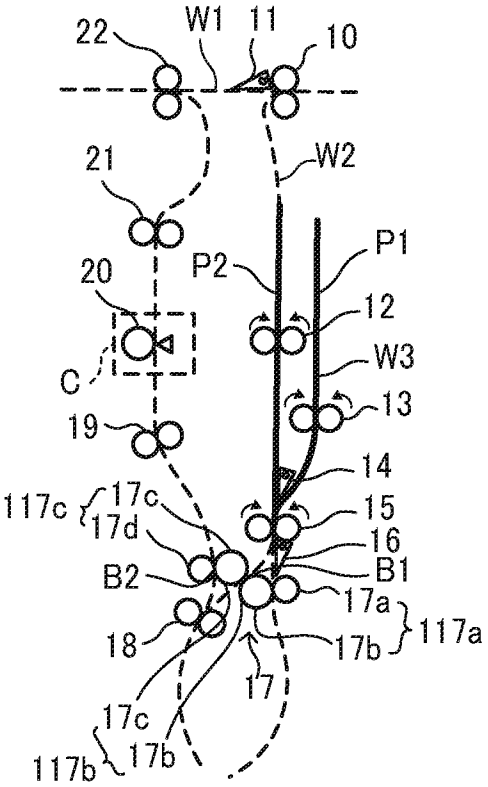
Figure 6E:
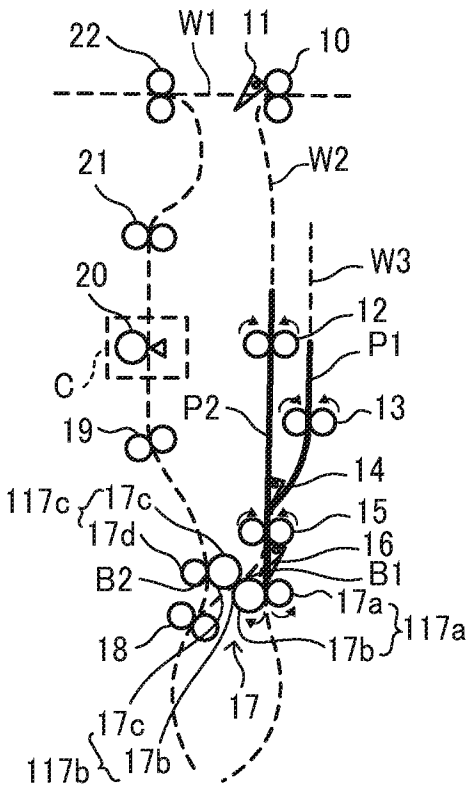
Figure 6F:
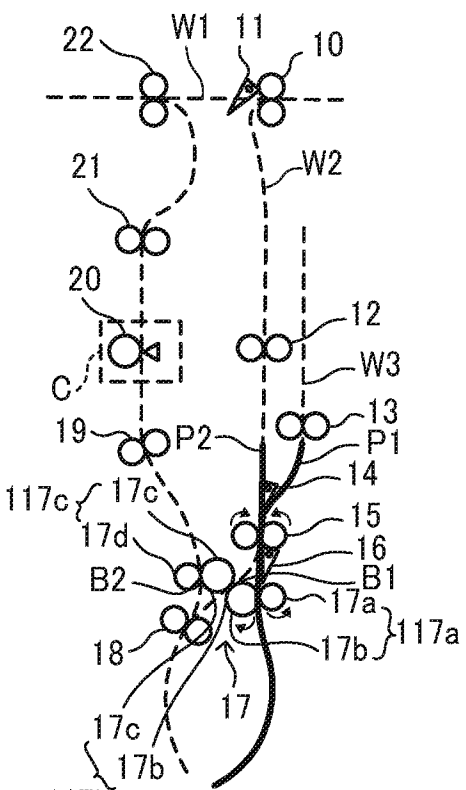

Next, a leading edge of the following second sheet P2 contacts the registration roller pair 15. As illustrated in FIG. 6D, even after the leading edge of the following sheet P2 contacts the registration roller pair 15, the conveyance roller pair 12 continues to convey the following sheet P2 and bends the following sheet P2 to correct the skew of the following sheet P2. As illustrated in FIG. 6E, after a predetermined time in which the following sheet is bent by a predetermined amount has passed, the registration roller pair 15, the switchback conveying roller pair 13, and the first conveyance roller pair 117*a* rotate. As illustrated in FIG. 6F, the registration roller pair 15 conveys the first sheet P1 and the second sheet P2 in an overlaid manner.

When the number of overlaid sheets reaches the number set by the user, the folding section B starts the folding processing. On the other hand, when the number of overlaid sheets does not reach a number set by the user, the overlaid sheets are conveyed in the reverse direction when the trailing edge of the overlaid sheets has passed through the second bifurcating claw 14 and evacuates to the switchback conveyance path W3. The sheets P are overlaid by repeating the above operation according to the number of sheets to be overlaid.

In the present embodiment, as described above, the skew of the following sheet P2 is corrected without stopping the rotation of the conveyance roller pair 12, and the registration roller pair 15 starts to rotate when the bending amount of the following sheet P2 reaches the predetermined amount. Therefore, it is possible to overlay the preceding first sheet and the following second sheet without reducing productivity.

While the number of the overlaid sheets does not reach the number set by the user, an overlay process without the skew correction by the registration roller pair 15 may be performed, and, when the number of the overlaid sheets reaches the number set by the user, the overlay process with the skew correction by the registration roller pair 15 may be performed. In the overlay process with the skew correction, the switchback conveying roller pair 13 strikes the leading edge of the preceding sheet P1 or a preceding sheet bundle against the registration roller pair 15 to correct the skew and puts the sheet P1 or the preceding sheet bundle on standby, and, after the conveyance roller pair 12 strikes the leading edge of the following sheet P2 against the registration roller pair 15 to correct the skew, the registration roller pair 15 conveys the overlaid sheets. On the other hand, in the overlay process without the skew correction, the leading edge of the preceding sheet P1 or the sheet bundle is placed in the switchback conveyance path W3 and put on standby. Then, the switchback conveying roller pair 13 starts to convey the preceding sheet P1 or the preceding sheet bundle so that the preceding sheet P1 or the preceding sheet bundle placed on the switchback conveyance path W3 reaches the registration roller pair 15 when the following sheet P2 reaches the registration roller pair 15, and the sheets are overlaid. The registration roller pair 15 conveys the overlaid sheets.

FIGS. 7A to 7D are explanatory diagrams illustrating the general operation when the folding section B performs the Z-folding processing.

The leading edge of a sheet bundle Pt conveyed by the registration roller pair 15 after the overlay process enters the first conveyance roller pair 117*a* including the first folding roller 17*b* and the first pressing roller 17*a*. Next, when the sheet bundle Pt is conveyed by a predetermined conveyance amount Δ1, a drive motor to drive the folding mechanism 17 reversely rotates. A travel distance at this time is appropriately determined depending on the length of the sheet bundle Pt in the sheet conveyance direction and the content of the folding processing, such as the manner of folding.

Figure 7A:
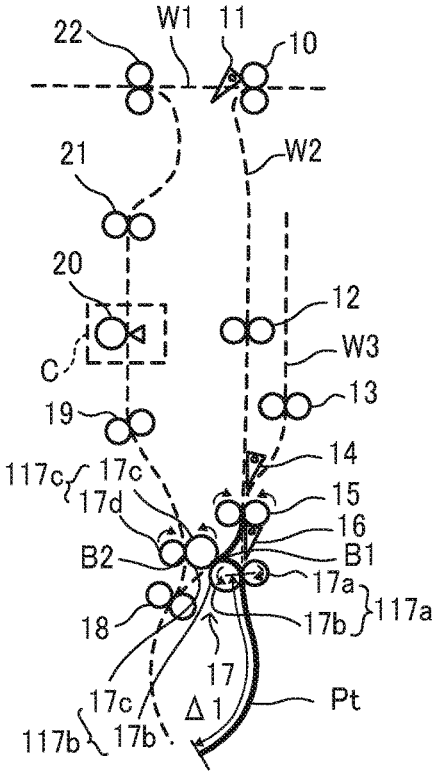
FIGS. 7A to 7D are explanatory diagrams illustrating a general operation when a folding section performs Z-folding processing.

Reverse rotation of the drive motor to drive the folding mechanism 17 conveys the sheet bundle Pt sandwiched by the first conveyance roller pair 117*a* in the reverse direction, that is, the direction opposite to the predetermined direction. This forms a bend in the sheet bundle portion between the registration roller pair 15 and the first conveyance roller pair 117*a* as illustrated in FIG. 7A. This bend, which is also called a folded-back portion, enters a nip between a first folding roller pair 117*b* including the first folding roller 17*b* and the second folding roller 17*c*, which forms the first folded portion in the folded-back portion. The first folded portion passing through the nip of the first folding roller 17*b* is conveyed toward the second conveyance roller pair 18 serving as a second conveyance member.

The first folded portion in the sheet bundle Pt enters the nip between the second conveyance roller pair 18. When the second conveyance roller pair 18 conveys the sheet bundle Pt by a predetermined conveyance amount Δ2, the second conveyance roller pair 18 reversely rotates and conveys the sheet bundle Pt sandwiched by the second conveyance roller pair 18 in the reverse direction that is the direction opposite to the predetermined direction. The conveyance amount Δ2 is appropriately determined depending on the length of the sheet bundle Pt in the sheet conveyance direction and a content of the folding processing such as folding manner.

Figure 7B:
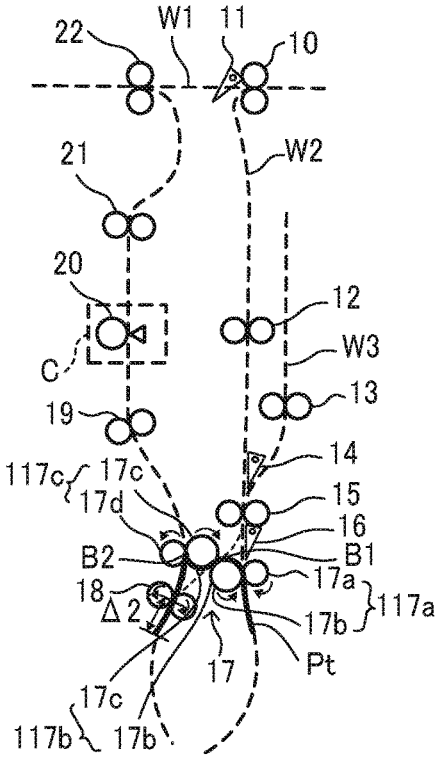

The conveyance of the sheet bundle Pt sandwiched by the second conveyance roller pair 18 in the reverse direction forms a bend in the sheet bundle between the first folding roller pair 117*b* and the second conveyance roller pair 18. As illustrated in FIG. 7B, this bend, which is also called a folded-back portion, enters a nip between a second folding roller pair 117*c* including the second folding roller 17*c* and the second pressing roller 17*d*, which forms the second folded portion in the folded-back portion.

Figure 7C:
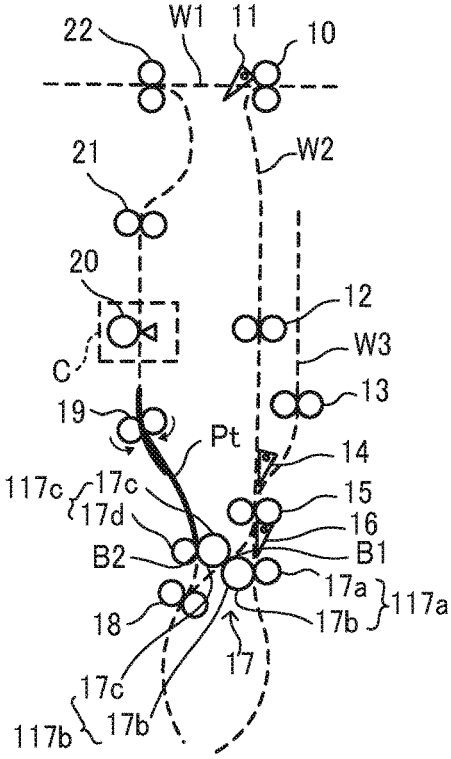
Figure 7D:
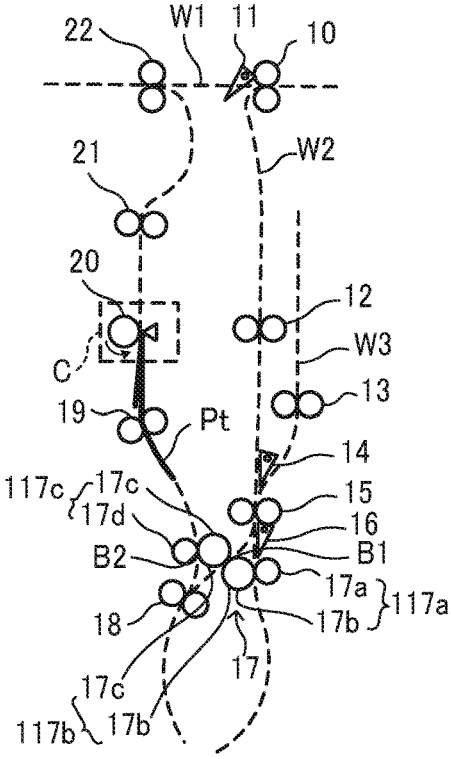

As illustrated in FIG. 7C, an intermediate conveyance roller pair 19 conveys the sheet bundle Pt including the two folded portions formed as described above, which has passed through the nip of the second folding roller pair 117*c*, toward the additional folding roller 20. As illustrated in FIG. 7D, when the second folded portion reaches the position opposed to the additional folding roller 20, the conveyance of the sheet bundle Pt is stopped. Next, the additional folding roller 20 rotates to put a sharp crease at the second folded portion, and the conveyance of the sheet bundle Pt is resumed. When the first folded portion reaches the position opposed to the additional folding roller 20, the conveyance of the sheet bundle Pt is stopped. The additional folding roller 20 rotates to put a sharp crease at the first folded portion, and the conveyance of the sheet bundle Pt is resumed. Two conveyance roller pairs 21 and 22 convey the sheet bundle Pt, and the conveyance roller pair 22 ejects the sheet bundle Pt to the post-processing apparatus 2.

In the above description, the sheet bundle Pt after the overlay process is folded. The folding process to fold one sheet is also the same. In the above description, Z folding-processing is described. The same operation as the Z-folding processing in which the conveyance amount Δ1 and the conveyance amount Δ2 are appropriately changed enables the inner three-fold and the outer three-fold to be carried out. In double folding processing, the third bifurcating claw 16 pivots in the clockwise direction in FIGS. 7A to 7D to adopt a posture for guiding the sheet to the first folding roller pair 117*b*, and the sheet conveyed from the registration roller pair 15 is conveyed to the first folding roller pair 117*b*. Then, the same operation as the above-described operation to form the second folded portion forms the folded portion at the center of the sheet in the conveyance direction, which enables double folding.

Figure 8:
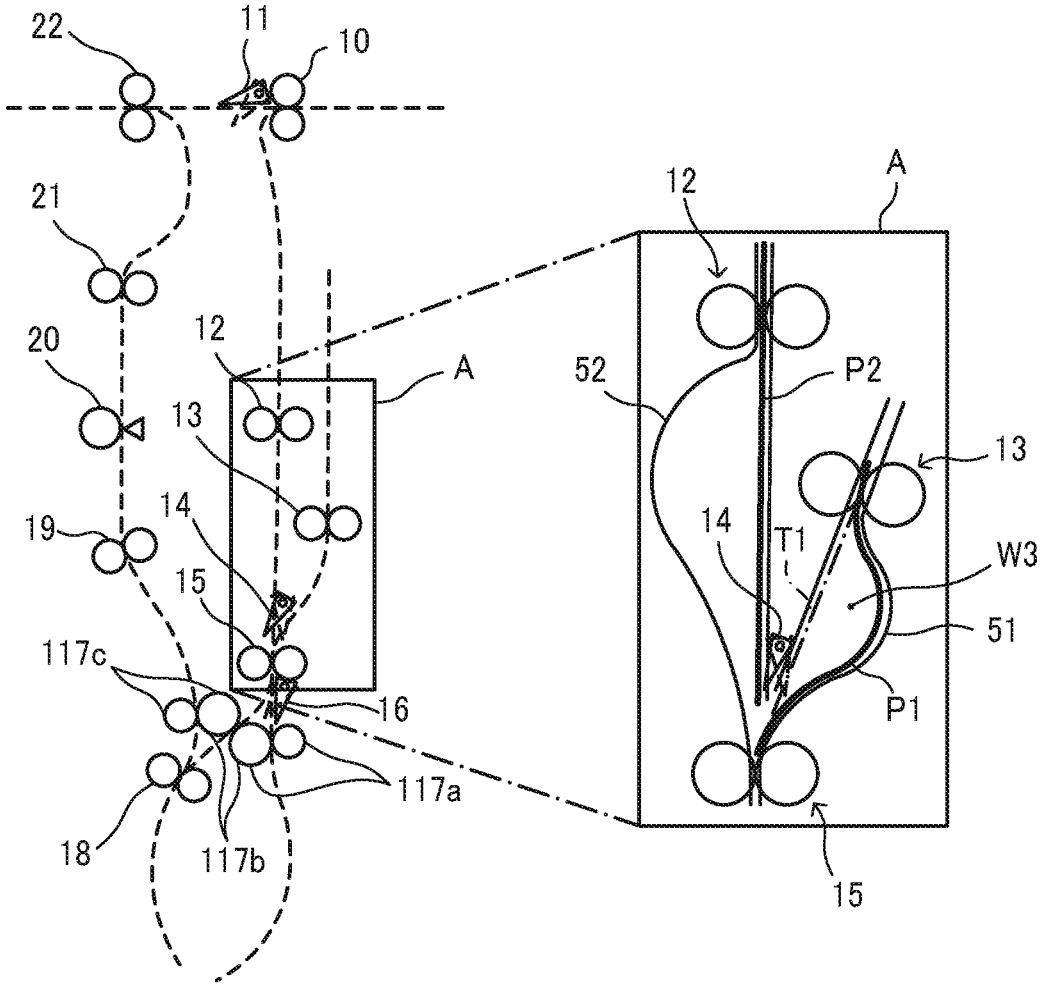
FIG. 8 is an enlarged diagram illustrating a configuration of an overlay section in the image forming system of FIG. 1.

FIG. 8 is an enlarged diagram illustrating a configuration of an overlay section A according to the present embodiment.

As illustrated in FIG. 8, there is a space 51 in the switchback conveyance path W3 to bend the preceding sheet on the side opposite the folding processing conveyance path W2 with respect to a line segment T1 that connects a nip between the switchback conveying roller pair 13 serving as a nip in the preceding sheet conveyer and a nip between the registration roller pair 15 serving as a nip in the registration conveyer. The space 51 to bend the preceding sheet is wider than a space on the side of the folding processing conveyance path W2. Specifically, to create the space 51 to bend the preceding sheet on the side opposite the folding processing conveyance path W2, a guide on the side opposite the folding processing conveyance path W2 among a pair of guides to guide the sheet or the sheet bundle in the switchback conveyance path W3 is bent to the side opposite the folding processing conveyance path W2.

Additionally, there is a space 52 to bend the following sheet between the conveyance roller pair 12 and the registration roller pair 15 on the folding processing conveyance path W2. In the present embodiment, the space 52 to bend the following sheet is provided on the side opposite the switchback conveyance path W3. Alternatively, the space 52 to bend the following sheet may be provided on the side of the switchback conveyance path W3.

The above-described space 51 to bend the preceding sheet and the above-described space 52 to bend the following sheet are wider than a space where the sheet bends more than the maximum skew amount that occurs until the leading edge of the sheet contacts the registration roller pair 15. In skew correction of the preceding sheet P1 and skew correction of the following sheet P2, the sheet is controlled to bend more than the maximum skew amount. Specifically, in the skew correction of the preceding sheet P1, the first motor controller 45 controls conveyance by the switchback conveying roller pair 13 so that a sheet conveyance amount conveyed by the switchback conveying roller pair 13 after the leading edge of the preceding sheet P1 contacts the registration roller pair 15 becomes more than the maximum skew amount. On the other hand, in the skew correction of the following sheet P2, the first motor controller 45 controls conveyance by the registration roller pair 15 to start the conveyance by the registration roller pair 15 when the conveyance amount of the conveyance roller pair 12 becomes equal to or larger than the maximum skew amount after the leading edge of the following sheet P2 abuts on the registration roller pair 15.

In the present embodiment, since the space 51 to bend the preceding sheet P1 is provided on the side opposite the folding processing conveyance path W2 in the switchback conveyance path W3, the preceding sheet P1 or the sheet bundle can be folded in the space 51 to bend the preceding sheet P1 on the side opposite the folding processing path W2 when the skew of the preceding sheet P1 is corrected. This makes it possible to prevent the preceding sheet P1 after the skew correction from closing the folding processing conveyance path W2 and smoothly convey the following sheet P2 to the registration roller pair 15, which avoids the occurrence of the conveyance trouble of the following sheet.

Additionally, in the present embodiment, skew correction of the preceding sheet P1 and the following sheet P2 by the registration roller pair 15 decreases the misalignment between the preceding sheet P1 and the following sheet P2.

Figure 9A:
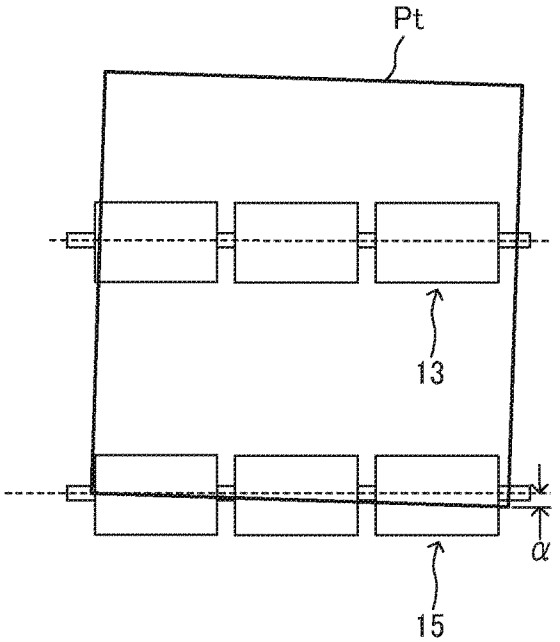
FIGS. 9A to 9C are explanatory diagrams illustrating a disadvantage that occurs when a sheet bundle contacts a registration roller pair.
Figure 9B:
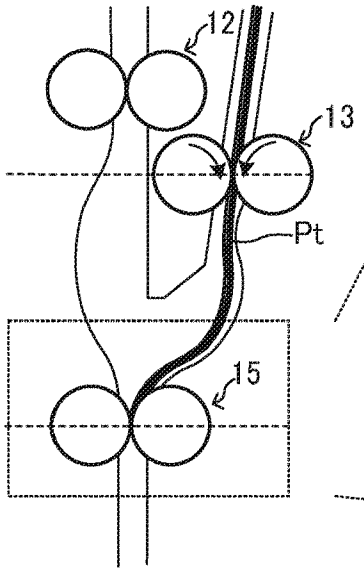
Figure 9C:
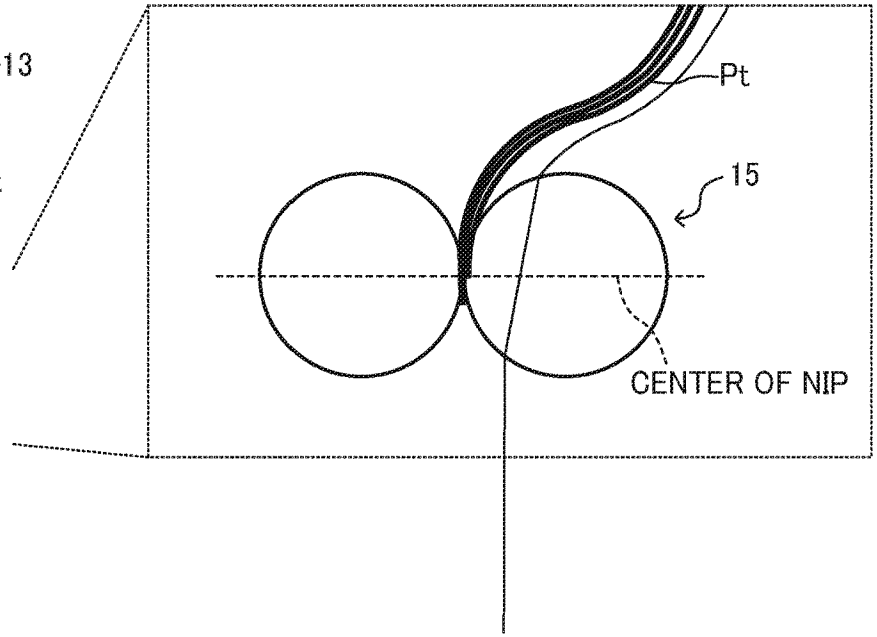

FIGS. 9A to 9C are explanatory diagrams illustrating a disadvantage that occurs when a sheet bundle contacts the registration roller pair 15.

When three or more sheets are overlaid, the sheet bundle is conveyed to the switchback conveyance path W3 and contacts the registration roller pair 15 to perform the skew correction, and the leading edges of sheets of the sheet bundle are aligned. However, due to the hardness of the sheet, at least one of sheets of the sheet bundle may enter a nip of the registration roller pair, which results in a failure of accuracy of the leading-edge alignment of the sheet bundle. This failure causes a disadvantage that a position of the folded portion of the sheet having the leading edge positioned at a downstream side compared with other sheets because the sheet enters the nip of the registration roller pair is different from positions of folded portions of the other sheets.

Note that, in the present disclosure, the description "leading-edge alignment of the sheet bundle" means aligning leading edges of sheets of the sheet bundle.

In addition, as illustrated in FIG. 9A, when the leading edges of the sheets of the sheet bundle contacts the registration roller pair 15, depending on an amount of skew of the sheet bundle, one end of at least one of sheets of the sheet bundle in the sheet width direction may enter into the nip of the registration roller pair up to a length a in FIG. 9A. In this case, after one end of the sheet described above in the sheet width direction enters the nip of the registration roller pair 15, the other end of the sheet in the sheet width direction contacts the registration roller pair 15 to perform the skew correction. At this time, a wedge-shaped fold along the sheet conveyance direction may be generated on a leading end side of the sheet described above, or a leading end of the sheet at the other end in the sheet width direction may rise. When the registration roller pair 15 conveys the sheet bundle including the sheet on the leading end side of which the wedge-shaped fold along the sheet conveyance direction is generated, a vertical wrinkle may be generated on the leading end side of the sheet. When the registration roller pair 15 conveys the sheet bundle including the sheet where the leading end at the other end in the sheet width direction rises, a corner of the sheet at the leading end at the other end in the sheet width direction may bend.

Therefore, in the present embodiment, when the sheet bundle contacts the registration roller pair 15, the registration roller pair 15 rotates in reverse. A description of the detailed configurations is given below with reference to drawings.

FIGS. 10A to 10F are explanatory diagrams illustrating a sheet overlay operation executed by an overlay section A in the present embodiment.

As described above, and as illustrated in FIGS. 10A to 10C, the switchback conveying roller pair 13 serving as a sheet bundle conveyance device leads the sheet bundle Pt conveyed to the switchback conveyance path W3 to contact the registration roller pair 15, bend the sheet bundle Pt, correct the skew, and align the leading edges of the sheets of the sheet bundle Pt.

Figure 10A:
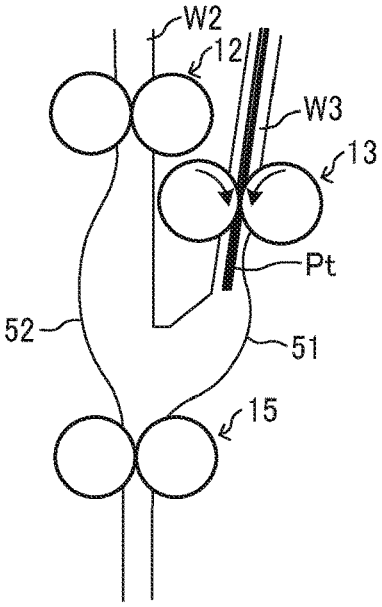
FIGS. 10A to 10F are explanatory diagrams illustrating a sheet overlay operation executed by the overlay section A in the image forming system of FIG. 1.
Figure 10B:
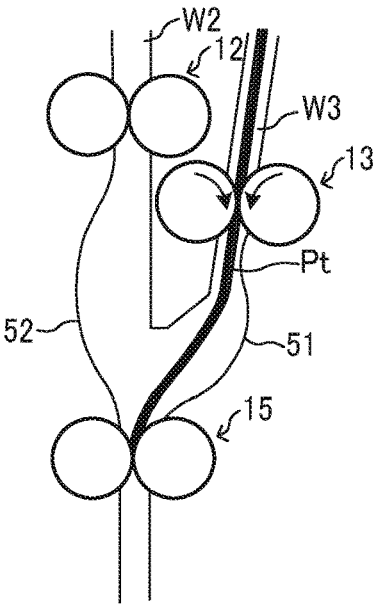
Figure 10C:
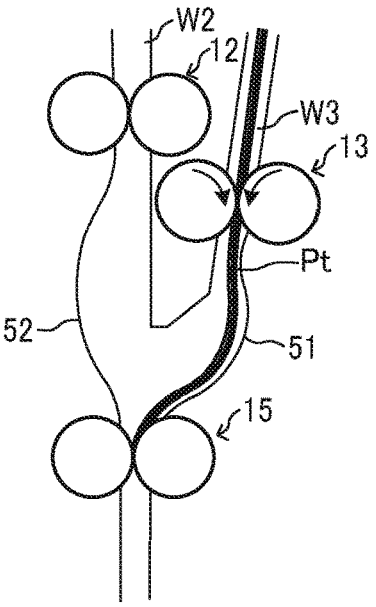
Figure 10D:
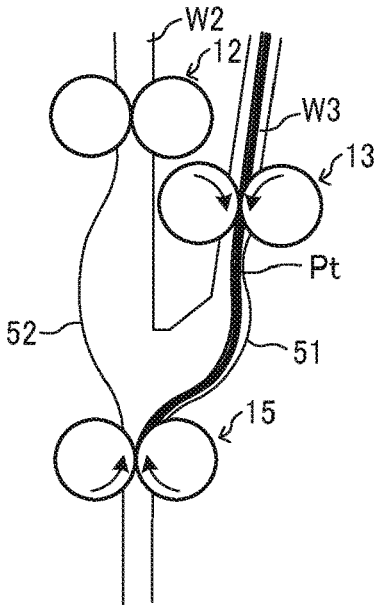
Figure 10E:
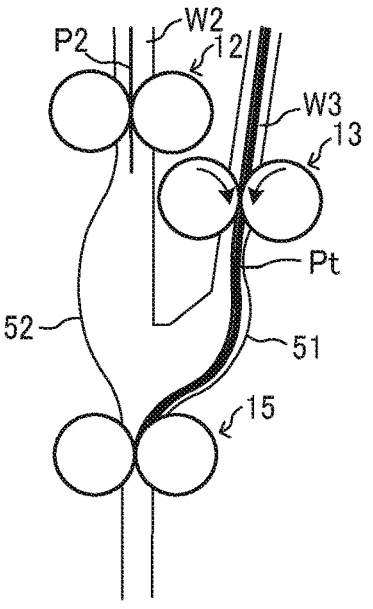
Figure 10F:
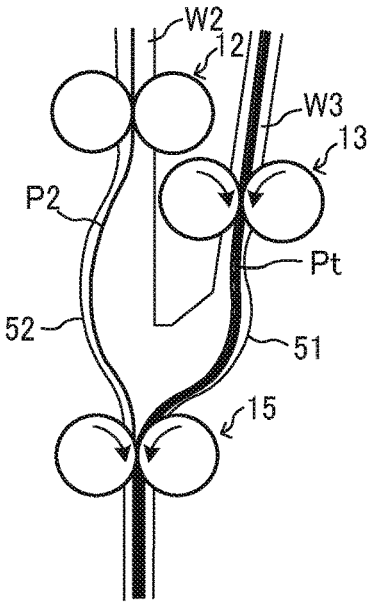

Next, as illustrated in FIG. 10D, the registration roller pair 15 rotates in reverse for a predetermined period. After the registration roller pair 15 rotates in reverse for a predetermined period, the following sheet P2 is conveyed as illustrated in FIG. 10E, and the conveyance roller pair 12 leads the leading edge of the following sheet P2 to contact the registration roller pair 15, bends the following sheet P2, corrects the skew, and aligns the leading edges of the sheets of the sheet bundle Pt and the following sheet P2. After that, the registration roller pair 15 conveys the sheet bundle as illustrated in FIG. 10F.

FIGS. 11A to 11D are enlarged drawings illustrating the registration roller pair 15 when the overlay section A performs the sheet overlay operation illustrated in FIGS. 10C to 10E.

Figure 11A:
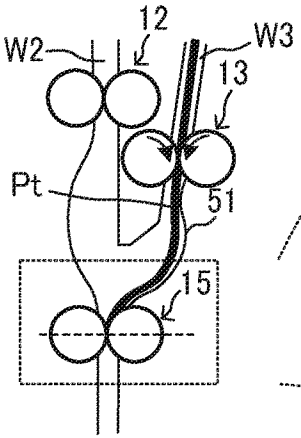
FIGS. 11A to 11D are enlarged drawings illustrating the registration roller pair when the overlay section A performs the sheet overlay operation illustrated in FIGS. 10C to 10E.
Figure 11B:
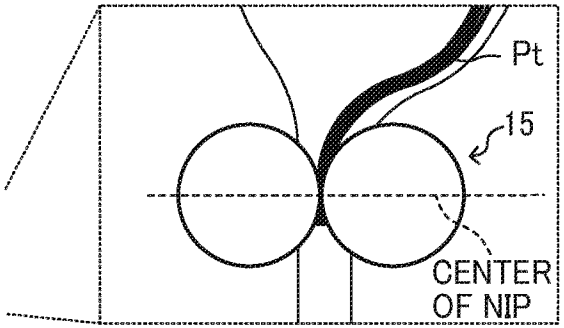
Figure 11C:
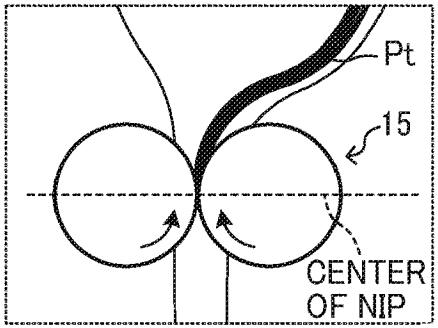
Figure 11D:
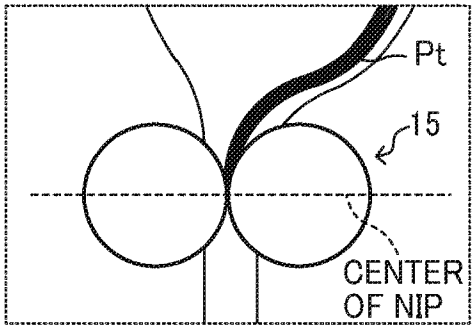

As illustrated in FIG. 11B, after the switchback conveying roller pair 13 leads the sheet bundle Pt to contact the registration roller pair 15 and correct the skew, the leading edge of at least one of the sheets of the sheet bundle Pt enters the nip of the registration roller pair 15. Reverse rotations of the registration roller pair 15 for the predetermined period after the above-described situation leads the leading edge of the at least one of the sheets of the sheet bundle Pt that enters the nip of the registration roller pair 15 to eject from the nip of the registration roller pair 15 to an upstream side from the nip as illustrated in FIG. 11C. Since the sheets are bent between the switchback conveying roller pair 13 and the registration roller pair 15, resilience of the sheets causes the leading edge of the sheets ejected from the nip to move in a direction toward the registration roller pair 15. As a result, the leading edge of the sheet ejected from the nip contacts the registration roller pair 15 as illustrated in FIG. 11D. This leads all the sheets of the sheet bundle to contact the registration roller pair 15 and the leading edges of the sheets of the sheet bundle well aligned.

What the leading edge of at least one of the sheets of the sheet bundle Pt that has entered the nip of the registration roller pair 15 comes out of the nip of the registration roller pair 15 eliminates the wedge-shaped fold along the sheet conveyance direction generated on the leading end side of the sheet and a rising portion of the leading edge of the sheet at the other end, that is, a side at which the leading edge of the sheet does not enter the nip. This prevents at least one of the sheets of the sheet bundle from bending a corner of the sheet or occurring the longitudinal wrinkle.

Or, after the overlay process without the skew correction until the number of the overlaid sheets reaches the number set by the user, the sheet bundle may be conveyed to the switchback conveyance path W3, that is, switchback conveying may be performed. Subsequently, after the skew correction illustrated in FIGS. 10A to 10D results in the alignment of the leading edges of the sheets of the sheet bundle, the sheet bundle may be conveyed to the folding section B. In the above-described operations, start timing and the period of the reverse rotations of the registration roller pair are preferably calculated and set so that the sheet bundle bends to a predetermined amount when the registration roller pair starts to rotate in forward. Since these operations do not need to stop rotations of the switchback conveying roller pair 13, productivity is improved.

Similar to the operations of the sheet bundle described above, after the leading edge of the following sheet contacts the registration roller pair 15, the registration roller pair 15 may rotate in reverse.

FIGS. 12A to 12E are explanatory diagrams illustrating skew correction of the following sheet P2.

Figure 12A:
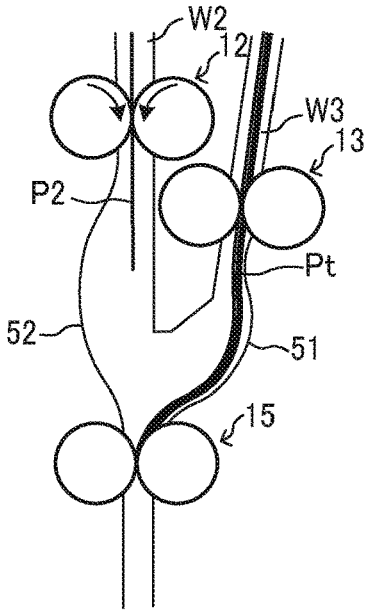
FIGS. 12A to 12E are explanatory diagrams illustrating skew correction control of a following sheet.
Figure 12B:
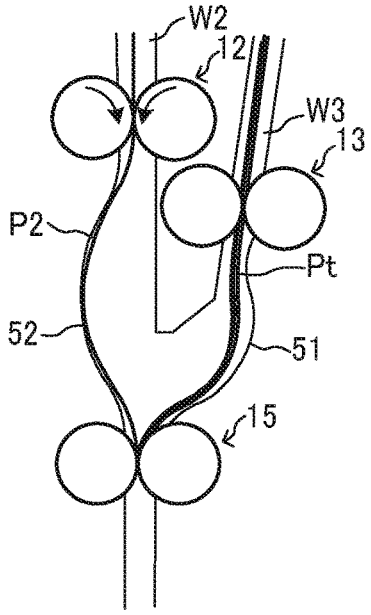

After a skew correction of the sheet bundle that is similar to the skew correction illustrated in FIGS. 10A to 10D, the following sheet P2 contacts the registration roller pair 15 and bends to correct the skew, and the leading edges of the sheets of the sheet bundle and the following sheet P2 are aligned as illustrated in FIGS. 12A and 12B. In the skew correction described above, if the leading edge of the following sheet P2 enters the nip of the registration roller pair 15, the leading edge of the following sheet and the leading edges of the sheets of the sheet bundle are not aligned, resulting in misalignment between the sheet bundle and the following sheet P2 in the sheet conveyance direction. If a skew amount of the following sheet P2 is large, the leading edge of the following sheet P2 at one end of the following sheet P2 in the width direction may enter the nip of the registration roller pair 15. This may generate the wedge-shaped fold along the sheet conveyance direction on the leading end side of the following sheet P2 and cause the leading end of the following sheet P2 at the other end the following sheet P2 in the width direction to rise.

Figure 12C:
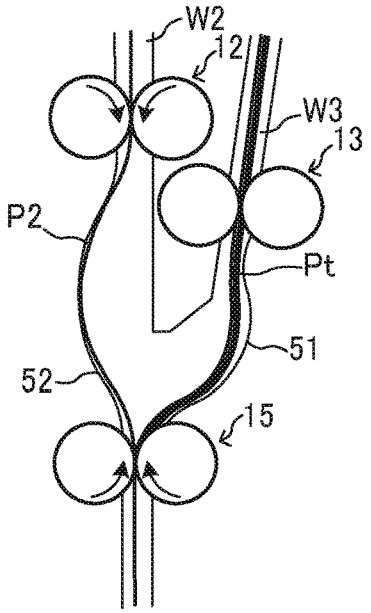
Figure 12D:
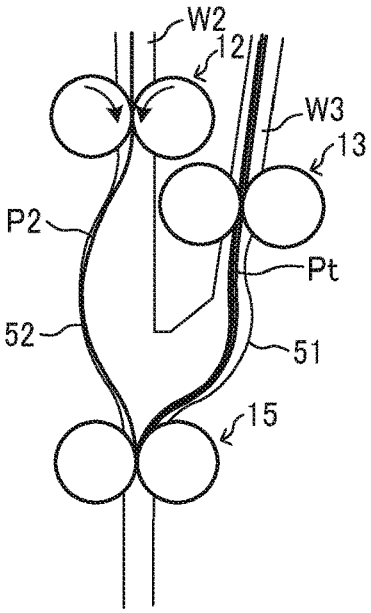

Therefore, as illustrated in FIG. 12C, after the leading edge of the following sheet P2 contacts the registration roller pair 15, the registration roller pair 15 rotates in reverse for a predetermined period. Reverse rotations of the registration roller pair 15 for the predetermined period ejects the leading edge of the following sheet P2 that enters the nip of the registration roller pair 15 from the nip of the registration roller pair 15 to the upstream side from the nip as illustrated in FIG. 12C. Since the sheets are bent between the conveyance roller pair 12 and the registration roller pair 15, resilience of the sheets acts the leading edge of the sheets ejected from the nip to move in a direction toward the registration roller pair 15. As a result, the leading edge of the following sheet ejected from the nip contacts the registration roller pair 15 as illustrated in FIG. 12D. This precisely aligns the leading edge of the following sheet and the leading edges of the sheets of the sheet bundle. Additionally, this eliminates the wedge-shaped fold along the sheet conveyance direction generated on the leading end side of the following sheet and a rising portion of the leading edge of the following sheet at the other end, that is, a side at which the leading edge of the following sheet does not enter the nip. This prevents the following sheet from bending a corner of the sheet and occurring the longitudinal wrinkle.

Figure 12E:
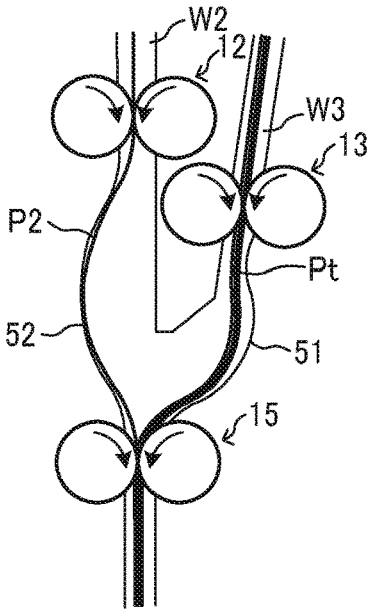

After the registration roller pair 15 rotates in reverse for a predetermined period, the registration roller pair 15 and the switchback conveying roller pair 13 rotate in forward to overlay the following sheet P2 and the sheet bundle as illustrated in FIGS. 12D and 12E.

Start timing of the reverse rotation of the registration roller pair 15 is set so that the following sheet P2 bends to a predetermined amount when the registration roller pair starts in forward. Therefore, as illustrated in FIGS. 12C to 12E, while the registration roller pair 15 rotates in reverse, and while the registration roller pair 15 and the switchback conveying roller pair 13 rotate in forward to overlay the following sheet P2 and the sheet bundle, the conveyance roller pair 12 continues to rotate and convey the following sheet P2. This improves the productivity of the overlay process.

The overlay process illustrated in FIGS. 12A to 12E may be performed only at a final overlay process in which the number of overlaid sheets reaches the number set by the user. That is, while the number of the overlaid sheets does not reach the number set by the user, the following sheet P2 may be conveyed without the skew correction as illustrated in FIGS. 10A to 10F, and, at the final overlay process in which the number of overlaid sheets reaches the number set by the user, the skew of the following sheet P2 may be corrected as illustrated in FIGS. 12A to 12E. This improves the productivity of the overlay process compared to the overlay process in which the skew correction of the following sheet P2 is performed each when the conveyance roller pair 12 conveys the following sheet P2 and the overlay process in which, after the final overlay process in which the number of overlaid sheets reaches the number set by the user, the registration roller pair 15 conveys the sheet bundle to the switchback conveyance path W3, and the switchback conveying roller pair 13 leads the sheet bundle to contact the registration roller pair 15, perform the skew correction, and align the leading edges of the sheets in the sheet bundle.

The controller 40 may change the period during which the registration roller pair 15 rotates in reverse depending on data of the sheet such as the type of sheet. For example, it is difficult for the leading edge of a soft sheet such as a thin sheet to enter the nip. Therefore, even when the period during which the registration roller pair 15 rotates in reverse is short, the leading edge of the thin sheet is reliably ejected from the nip of the registration roller pair 15. On the other hand, the leading edge of a rigid sheet such as a thick sheet may deeply enter the nip of the registration roller pair 15. Therefore, unless the period during which the registration roller pair 15 rotates in reverse is set to be long to increase a reverse rotation amount of the registration roller pair 15, the leading edge of the rigid sheet such as the thick sheet may not be ejected from the nip.

Therefore, as a thickness of the sheet of the sheet bundle is thick, the period during which the registration roller pair 15 rotates in reverse is preferably set to be longer to increase the reverse rotation amount of the registration roller pair 15. When the thickness of the sheet of the sheet bundle is thin, this shortens the period during which the registration roller pair 15 rotates in reverse and improves productivity. When the thickness of the sheet of the sheet bundle is thick, the long period during which the registration roller pair 15 rotates in reverse ensures the ejection of the leading edge of the sheet from the nip of the registration roller pair 15 and alignment of the leading edges of the sheets of the sheet bundle. Additionally, this prevents the sheet from bending the corner of the sheet or occurring the longitudinal wrinkle.

The folding apparatus 1 may get the thickness of the sheet of the sheet bundle from a basis weight of the sheet stored in the feeding cassette which the user inputs in a control panel of the image forming apparatus 3. Or, the folding apparatus 1 may get the thickness of the sheet of the sheet bundle from a thickness detection sensor such as a transmission photosensor disposed on the sheet conveyance path.

Next, a description is given of variations of the present embodiment described above.

First Variation

FIGS. 13A to 13E are explanatory diagrams illustrating skew correction of the sheet bundle in a first variation.

In the first variation, before the sheet bundle contacts the registration roller pair 15, the registration roller pair 15 rotates in reverse.

Figure 13A:
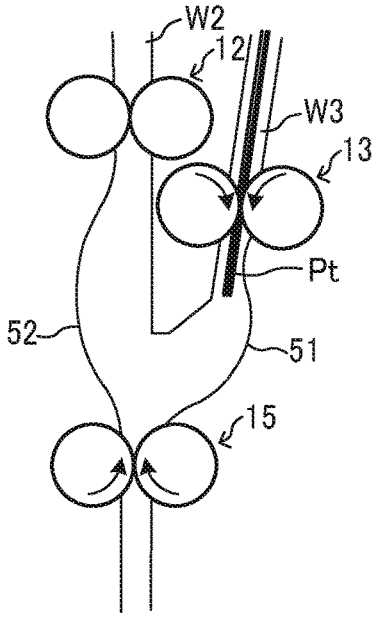
FIGS. 13A to 13E are explanatory diagrams illustrating skew correction control of a sheet bundle in a first variation.
Figure 13B:
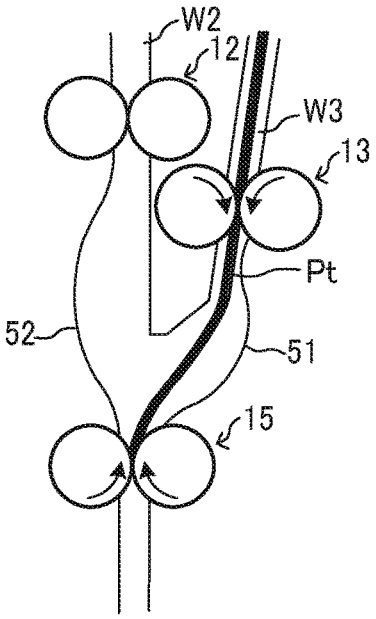

Even after the registration roller pair 15 conveys the sheet bundle Pt to the switchback conveyance path W3, the registration roller pair 15 continues to rotate in reverse. Next, the switchback conveying roller pair 13 rotates in forward as illustrated in FIG. 13A to contact the leading edges of the sheets of the sheet bundle Pt on the registration roller pair 15 as illustrated in FIG. 13B. At this time, since the registration roller pair 15 rotates in reverse, the reverse rotation of the registration roller pair 15 can eject the leading edge of the sheet which may enter the nip. This prevents at least one of the sheets of the sheet bundle from entering the nip of the registration roller pair 15. The leading edges of the sheets of the sheet bundle can be well aligned. In addition, this prevents at least one of the sheets of the sheet bundle Pt from occurring the wedge-shaped fold at the leading edge of the sheet, bending the corner of the sheet, and occurring the longitudinal wrinkle.

This variation improves productivity because, unlike the embodiment, the registration roller pair does not rotate in reverse for the predetermined period after the sheet bundle bends by a predetermined amount. However, when the soft sheet such as the thin sheet contacts the registration roller pair rotating in reverse, the leading edge of the sheet may be curled up and the corner of the sheet may be folded back. The embodiment has the advantage that the registration roller pair that rotates in reverse after the leading edge of the sheet contacts the registration roller pair, as described in the embodiment, prevents the leading edge of the soft sheet from being curled up. Therefore, it is preferable to select, based on the thickness of the sheet of the sheet bundle, either a method in which the registration roller pair rotates in reverse after the sheet contacts the registration roller pair or a method in which the registration roller pair starts rotating in reverse before the sheet contacts the registration roller pair.

FIGS. 14A to 14E are explanatory diagrams illustrating an operation when the skew correction of the first variation is performed on the following sheet P2.

Figure 13C:
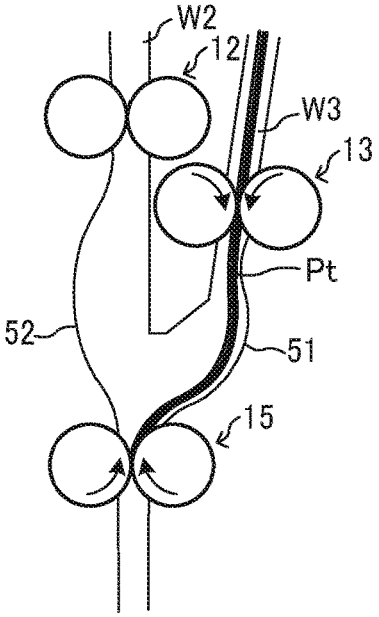
Figure 13D:
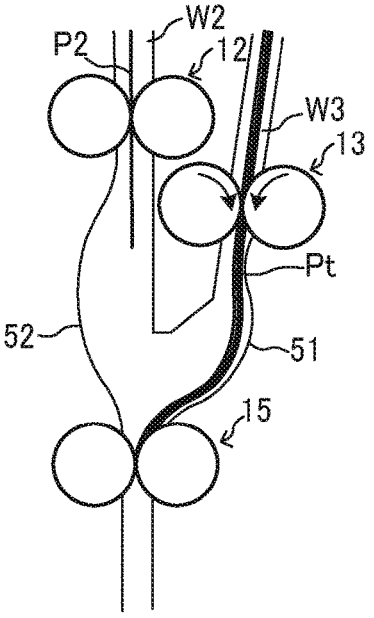
Figure 13E:
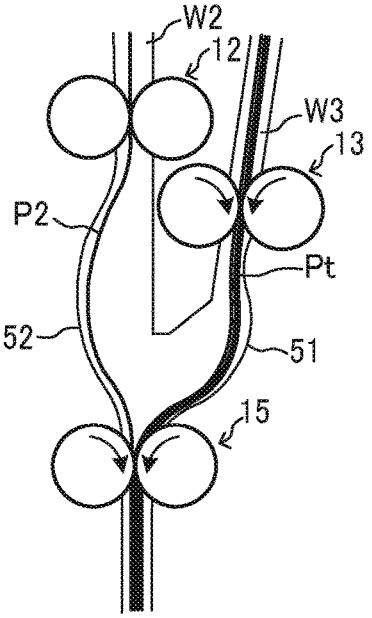
Figure 14A:
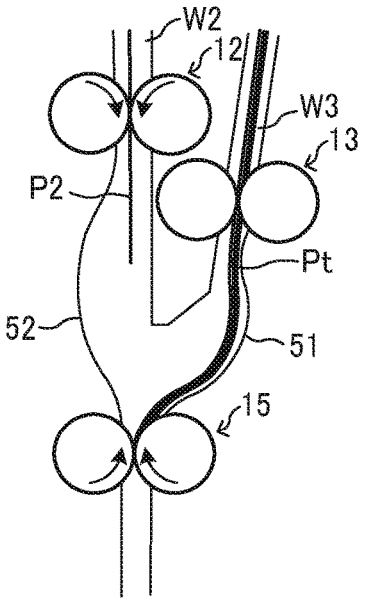
FIGS. 14A to 14E are explanatory diagrams illustrating an operation when the skew correction of the first variation is performed on the following sheet.
Figure 14B:
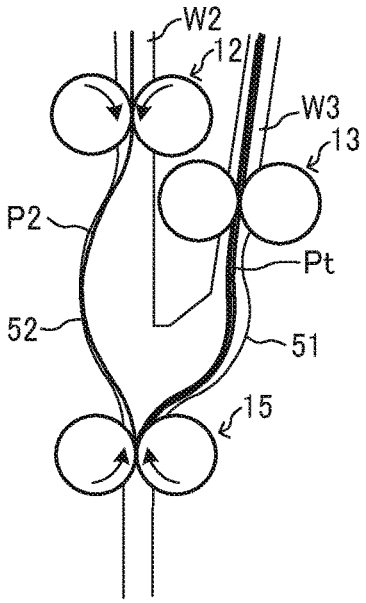
Figure 14C:
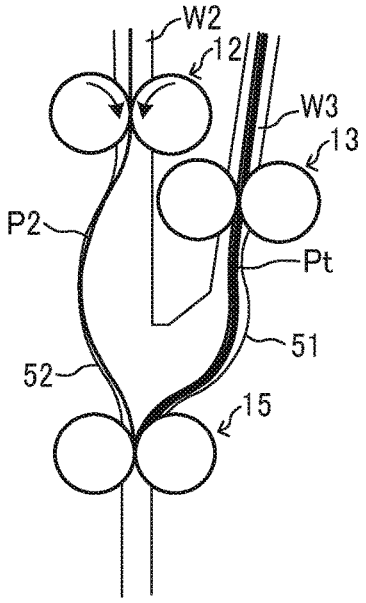
Figure 14D:
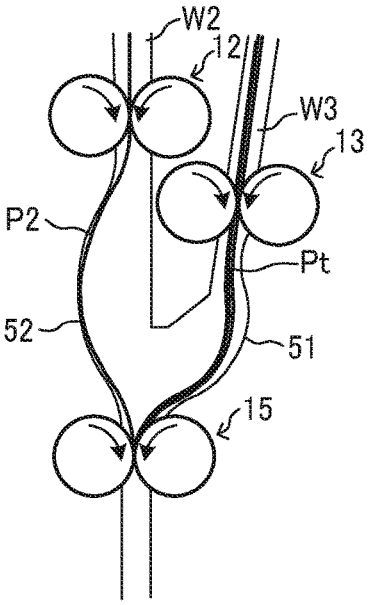
Figure 14E:
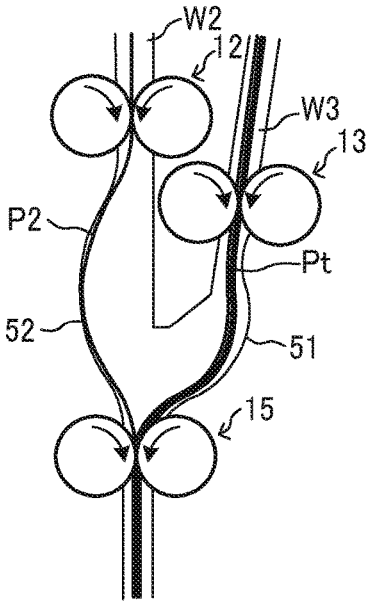

After the skew correction of the sheet bundle and the leading edge alignment of the sheet bundle which are done by a method illustrated in FIGS. 10A to 10C, that is, the method in which the registration roller pair rotates in reverse after the sheet contacts the registration roller pair, or a method illustrated in FIGS. 13A to 13C, that is, the method in which the registration roller pair starts rotating in reverse before the sheet contacts the registration roller pair, the registration roller pair 15 rotates in reverse as illustrated in FIG. 14A. Next, as illustrated in FIG. 14B, the following sheet P2 contacts the registration roller pair 15 rotating in reverse and bends by a predetermined amount, and, as illustrated in FIG. 14C, the registration roller pair 15 temporarily stops rotation. After the registration roller pair 15 temporarily stops rotation, the registration roller pair 15 and the switchback conveying roller pair 13 rotate in forward as illustrated in FIG. 14D to overlay and convey the following sheet P2 and the sheet bundle as illustrated in FIG. 14E.

Since the following sheet P2 contacts the registration roller pair 15 rotating in reverse, the leading edge of the following sheet P2 contacts the registration roller pair without entering the nip of the registration roller pair 15. This aligns the leading edge of the following sheet and the leading edges of the sheets of the sheet bundle and decreases the misalignment between the sheet bundle and the following sheet. In addition, this prevents at least one of the sheets of the sheet bundle from occurring the wedge-shaped fold at the leading edge of the sheet, bending the corner of the sheet, and occurring the longitudinal wrinkle.

Second Variation

FIGS. 15A to 15E are explanatory diagrams illustrating skew correction of the sheet bundle in a second variation.

In this second variation, the first conveyance roller pair 117*a* performs the skew correction and aligns the leading edges of the sheets of the sheet bundle Pt.

Figure 15A:
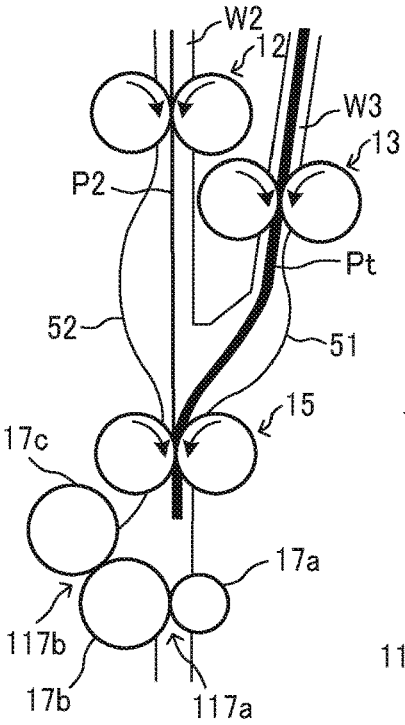
FIGS. 15A to 15E are explanatory diagrams illustrating skew correction of the sheet bundle in a second variation.

As illustrated in FIG. 15A, the switchback conveying roller pair 13 starts to convey the sheet bundle Pt so that the sheet bundle Pt placed on the switchback conveyance path W3 to wait the following sheet P2 reaches the registration roller pair 15 when the following sheet P2 reaches the registration roller pair 15, and the following sheet is overlaid on the sheet bundle Pt. The registration roller pair 15 conveys the sheet bundle including the following sheet P2.

Figure 15B:
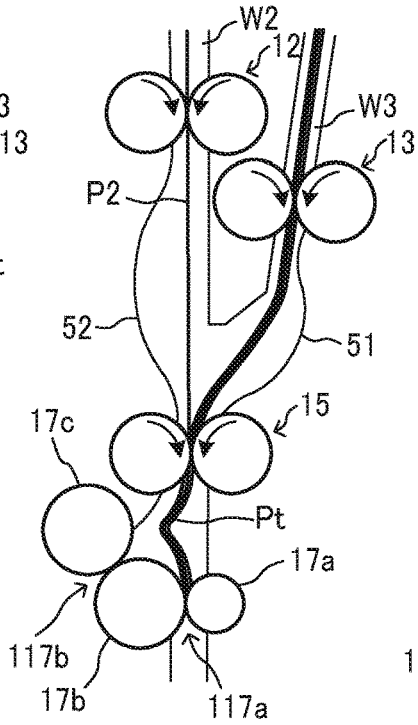

The first conveyance roller pair 117*a* does not rotate. As illustrated in FIG. 15B, after the leading edges of the sheets of the sheet bundle Pt contacts the first conveyance roller pair 117*a*, the registration roller pair 15 continues to rotate and bends the sheet bundle Pt between the registration roller pair 15 and the first conveyance roller pair 117*a* to correct the skew of the sheet bundle Pt.

Figure 15C:
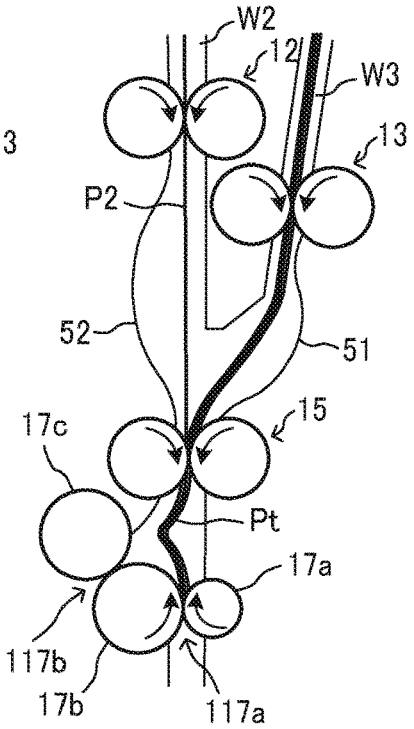

Next, as illustrated in FIG. 15C, the first conveyance roller pair 117*a* rotates in reverse to eject the leading edge of the sheet that enters the nip of the first conveyance roller pair 117*a* toward the upstream side in the conveyance direction. This aligns the leading edges of the sheets of the sheet bundle well. In addition, this prevents the sheet from occurring the wedge-shaped fold at the leading edge of the sheet.

Figure 15D:
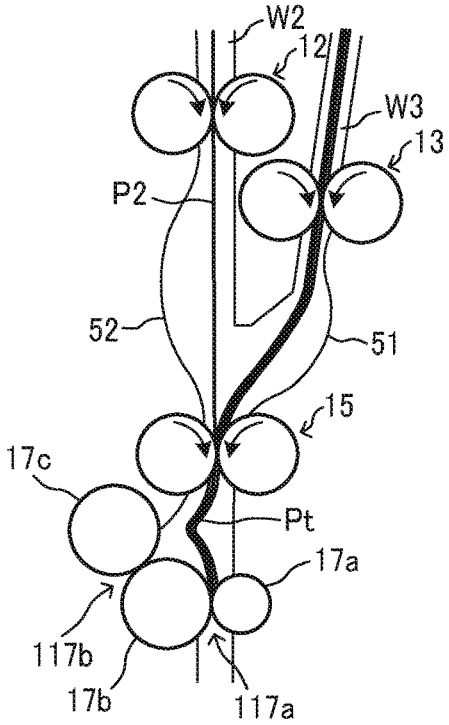
Figure 15E:
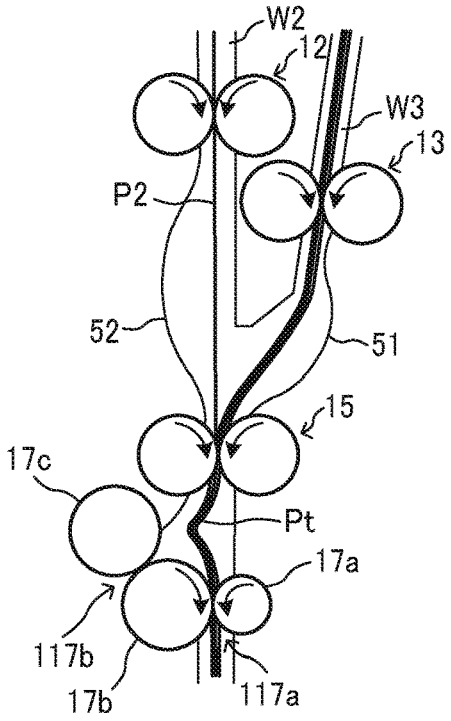

After the first conveyance roller pair 117*a* rotates in reverse for a predetermined period, the first conveyance roller pair 117*a* temporarily stops rotation as illustrated in FIG. 15D. Next, the first conveyance roller pair 117*a* rotates in forward to convey the sheet bundle Pt. If the number of overlaid sheets reaches the number set by the user, the first conveyance roller pair 117*a* rotates in reverse to perform the folding processing after the first conveyance roller pair 117*a* conveys the sheet bundle by the predetermined conveyance amount δ1. If the number of overlaid sheets does not reach the number set by the user, the registration roller pair 15 and the first conveyance roller pair 117*a* rotates in reverse to convey the sheet bundle to the switchback conveyance path W3 when the trailing edge of the sheet bundle pass through the fork between the folding processing conveyance path W2 and the switchback conveyance path W3.

In the second variation, start timing of the reverse rotation of the first conveyance roller pair 117*a* is also set so that the sheet bundle bends to a predetermined amount when the first conveyance roller pair 117*a* starts to rotate in forward. Since these operations can correct the skew without stopping rotation of the registration roller pair 15, productivity is improved.

The skew correction may be performed by the registration roller pair 15 and subsequently performed by the first conveyance roller pair 117*a*.

Or, after the overlay process without the skew correction until the number of the overlaid sheets reaches the number set by the user, the skew correction may be performed by the first conveyance roller pair 117*a*.

Third Variation

FIGS. 16A to 16E are explanatory diagrams illustrating skew correction of the sheet bundle in a third variation.

In the third variation, the first conveyance roller pair 117*a* rotates in reverse before the leading edges of the sheets of the sheet bundle contacts the first conveyance roller pair 117*a*. Other processes are the same as the processes of the second variation.

Figure 16A:
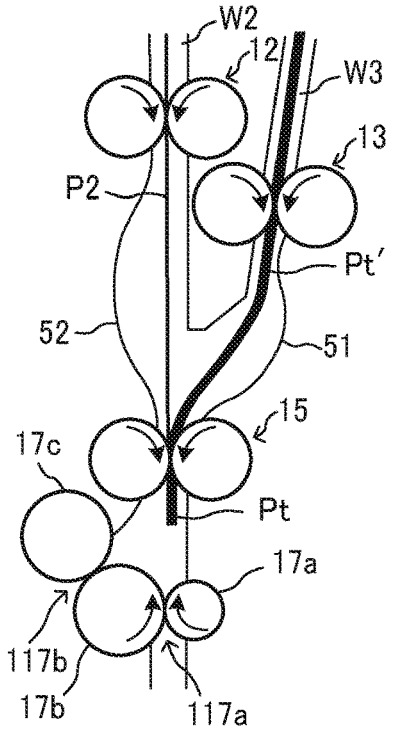
FIGS. 16A to 16E are explanatory diagrams illustrating skew correction of the sheet bundle in a third variation.
Figure 16B:
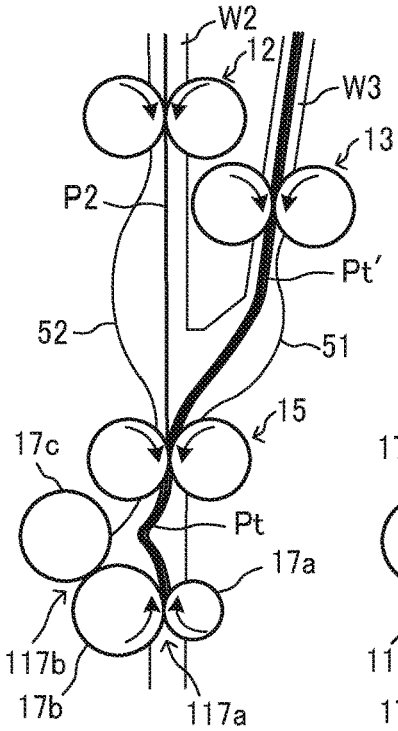

As illustrated in FIG. 16A, the switchback conveying roller pair 13 starts to convey the sheet bundle Pt' so that the sheet bundle Pt' placed on the switchback conveyance path W3 to wait the following sheet P2 reaches the registration roller pair 15 when the following sheet P2 reaches the registration roller pair 15, and the following sheet is overlaid on the sheet bundle Pt'. The registration roller pair 15 conveys the sheet bundle including the following sheet P2.

Next, as illustrated in FIG. 15B, the first conveyance roller pair 117*a* rotates in reverse, and the leading edges of the sheets of the sheet bundle Pt' contacts the first conveyance roller pair 117*a* rotating in reverse. This prevents at least one of the sheets of the sheet bundle from entering the nip of the first conveyance roller pair 117*a*. The leading edges of the sheets of the sheet bundle can be well aligned. In addition, this prevents the sheet from occurring the wedge-shaped fold at the leading edge of the sheet.

Figure 16C:
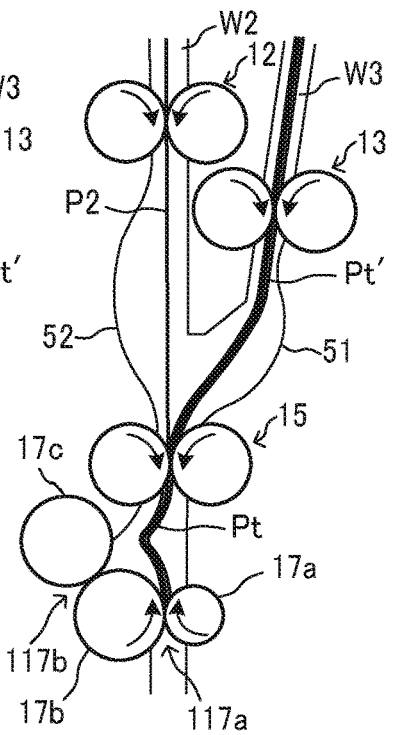

As illustrated in FIG. 16C, after the leading edges of the sheets of the sheet bundle Pt' contacts the first conveyance roller pair 117*a*, the registration roller pair 15 continues to rotate and bends the sheet bundle Pt' between the registration roller pair 15 and the first conveyance roller pair 117*a* to correct the skew of the sheet bundle Pt'.

Figure 16D:
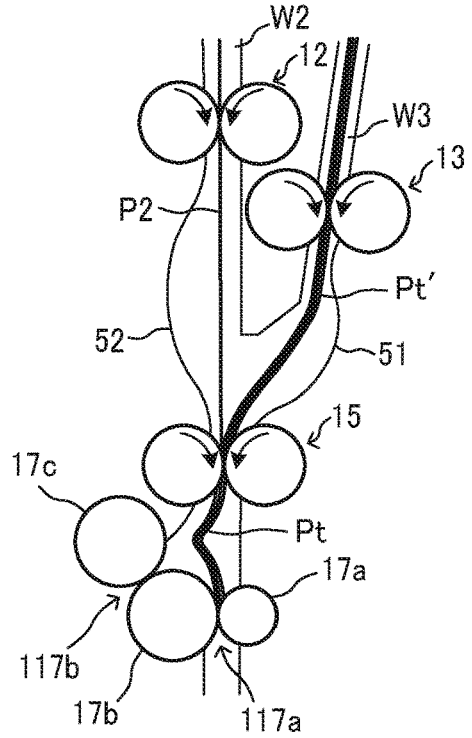
Figure 16E:
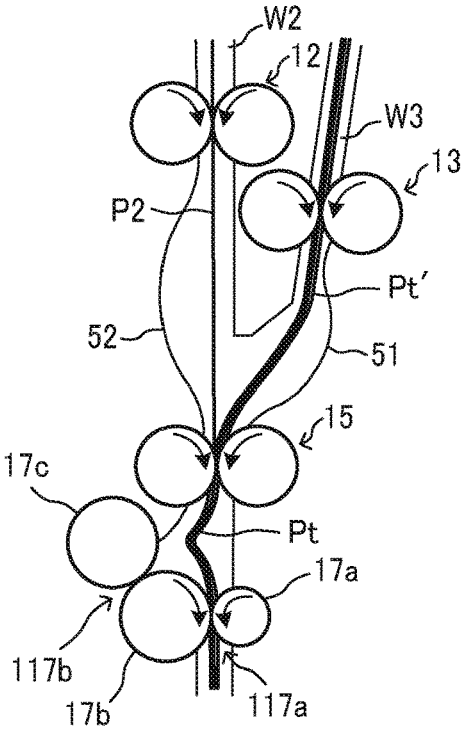

After the first conveyance roller pair 117*a* rotates in reverse for a predetermined period, the first conveyance roller pair 117*a* temporarily stops rotation as illustrated in FIG. 16D. Next, the first conveyance roller pair 117*a* rotates in forward to convey the sheet bundle Pt'. If the number of overlaid sheets reaches the number set by the user, the first conveyance roller pair 117*a* rotates in reverse to perform the folding processing after the first conveyance roller pair 117*a* conveys the sheet bundle by the predetermined conveyance amount Δ1. If the number of overlaid sheets does not reach the number set by the user, the registration roller pair 15 and the first conveyance roller pair 117*a* rotates in reverse to convey the sheet bundle to the switchback conveyance path W3 when the trailing edge of the sheet bundle pass through the fork between the folding processing conveyance path W2 and the switchback conveyance path W3.

In the present embodiment, the folding device B is disposed in the downstream of the overlay section A. However, the stapler that staples the sheet bundle, the punching device that punctures the punch hole in the sheet, or other devices may be disposed in the downstream of the overlay section A.

In the present disclosure, the term "sheet" means a sheet-like recording medium such as paper, plastic film, cloth, and the like.

The embodiment and variations described above are examples and provide the following advantages in a plurality of aspects, from a first aspect to a tenth aspect.

First Aspect

The sheet processing apparatus such as the folding apparatus 1 of a first aspect includes a roller pair such as the registration roller pair 15 to convey the sheet, a sheet bundle conveyer such as the switchback conveying roller pair 13 configured to convey a sheet bundle to the roller pair, and circuitry such as the controller 40 configured to cause the sheet bundle conveyer to contact leading edges of sheets of the sheet bundle to the roller pair and cause the roller pair to rotate in reverse to align the leading edges of the sheets of the sheet bundle.

In the sheet processing apparatus according to the first aspect, the roller pair that rotates in reverse ejects at least one of sheets of the sheet bundle that enters the nip of the roller pair to the upstream side from the nip when the leading edges of the sheets of the sheet bundle contacts the roller pair. Therefore, all the sheets of the sheet bundle contact the roller pair, and the leading edges of the sheets of the sheet bundle are well aligned. This enables processing at a desired position in each sheet of the sheet bundle.

Second Aspect

In a second aspect, the circuitry of the sheet processing apparatus according to the first aspect is configured to cause the roller pair to rotate in reverse after the leading edges of the sheets of the sheet bundle contact the roller pair.

In the sheet processing apparatus according to the second aspect, as described in the embodiment, the roller pair that rotates in reverse ejects at least one of sheets of the sheet bundle that enters the nip of the roller pair to the upstream side from the nip when the leading edges of the sheets of the sheet bundle contacts the roller pair. Therefore, the leading edges of all the sheets of the sheet bundle contact the roller pair and are well aligned. Additionally, this prevents the sheet from occurring the wedge-shaped fold at the leading edge of the sheet and prevents at least one of the sheets of the sheet bundle from bending the corner of the sheet or occurring the longitudinal wrinkle.

Unlike the sheet processing apparatus in which the roller pair rotates in reverse before the leading edges of the sheets of the sheet bundle contacts the roller pair, the roller pair that rotates in reverse after the leading edges of the sheets of the sheet bundle contacts the roller pair prevents the leading edge of the sheet from being curled up when the sheet bundle contacts the roller pair such as the registration roller pair 15 and prevents the corner of the sheet from bending.

Third Aspect

In a third aspect, the circuitry of the sheet processing apparatus according to the first aspect is configured to cause the roller pair to rotate in reverse before the leading edges of the sheets of the sheet bundle contact the roller pair.

In the third aspect, as described in the first variation, the reverse rotation of the roller pair can eject the leading edge of the sheet which may enter the nip. This prevents at least one of the sheets of the sheet bundle from entering the nip of the roller pair and enables the leading edges of the sheets of the sheet bundle to align well. In addition, this prevents at least one of the sheets of the sheet bundle from occurring the wedge-shaped fold at the leading edge of the sheet, bending the corner of the sheet, and occurring the longitudinal wrinkle.

This improves productivity compared to the sheet processing apparatus in which the roller pair such as the registration roller pair 15 rotates in reverse after the sheet bundle contacts the roller pair.

Fourth Aspect

In a fourth aspect, the circuitry of the sheet processing apparatus according to any one of the first aspect and the second aspect is configured to change, according to data of the sheet, a reverse rotation amount of the roller pair by which the roller pair rotates in reverse to align the leading edges of the sheets of the sheet bundle.

As described in the embodiment, the rigid sheet such as the thick sheet is easier to enter the nip of the roller pair than the soft sheet such as the thin sheet and goes deeper into the nip than the soft sheet. Therefore, changing the reverse rotation amount of the roller pair according to the type of the sheet when the leading edges of the sheets of the sheet bundle contacts the roller pair enables securely ejecting the sheet that enters the nip to the upstream side from the roller pair and good alignment of the leading edges of the sheets of the sheet bundle. Additionally, this prevents the sheet from occurring the wedge-shaped fold at the leading edge of the sheet and prevents at least one of the sheets of the sheet bundle from bending the corner of the sheet or occurring the longitudinal wrinkle.

Further, reducing the reverse rotation amount for the soft sheet such as the thin sheet that does not easily enter the nip improves productivity.

Fifth Aspect

In a fifth aspect, the circuitry of the sheet processing apparatus according to the fourth aspect is configured to increase the reverse rotation amount as a thickness of the sheet increases.

In the sheet processing apparatus according to the fifth aspect, as described in the embodiment, the roller pair reliably ejects the sheet that enters the nip of the roller pair to the upstream side from the roller pair and well aligns the leading edges of the sheets of the sheet bundle.

Sixth Aspect

In a sixth aspect, the sheet processing apparatus according to any one of the first aspect to the fifth aspect includes a conveyer such as the conveyance roller pair 12 to convey the following sheet, and the circuitry is configured to cause the conveyer to contact a leading edge of the following sheet to the roller pair to align the leading edges of the following sheet and the leading edges of the sheets of the sheet bundle after the leading edges of the sheets of the sheet bundle contacts the roller pair.

This enables aligning the leading edge of the following sheet and the leading edges of the sheets of the sheet bundle at the same time as the overlay process and improves productivity compared to the sheet processing apparatus in which the leading edge of the following sheet and the leading edges of the sheets of the sheet bundle are aligned after the overlay process.

Seventh Aspect

In a seventh aspect, the circuitry of the sheet processing apparatus according to the sixth aspect is configured to cause the roller pair to rotate in reverse to contact the leading edge of the following sheet to the roller pair.

As described in the embodiment, this prevents the following sheet from entering the nip of the roller pair and well aligns the leading edges of the sheets of the sheet bundle and the following sheet. Additionally, this prevents the following sheet from occurring the wedge-shaped fold at the leading edge of the following sheet and prevents the following sheet from bending the corner of the sheet or occurring the longitudinal wrinkle.

Eighth Aspect

In an eighth aspect, the sheet processing apparatus according to any one of the sixth aspect to the seventh aspect aligns the leading edge of the following sheet and the leading edges of the sheets of the sheet bundle as follows. At a final overlay process in which a number of overlaid sheets reaches a number set by a user, the circuitry is configured to cause the conveyer such as the conveyance roller pair 12 to contact the leading edge of the following sheet to the roller pair such as the registration roller pair 15 and bend the following sheet, cause the sheet bundle conveyer such as the switchback conveying roller pair 13 to contact the leading edges of the sheets of the sheet bundle to the roller pair and bend the sheet bundle, and, cause the roller pair to convey and overlay the following sheet and the sheet bundle.

As described embodiment, this improves productivity compared to the sheet processing apparatus in which the leading edge of the following sheet and the leading edges of the sheets of the sheet bundle are aligned each when the following sheet and the sheet bundle are overlaid and the sheet processing apparatus in which the switchback conveying roller pair conveys the sheet bundle after the final overlay process in which the number of overlaid sheets reaches the number set by the user and the leading edges of the sheets of the sheet bundle are aligned.

Ninth Aspect

In a ninth aspect, the sheet processing apparatus according to any one of the first aspect to the eighth aspect includes a sheet bundle processing device such as the folding section B disposed downstream from the roller pair in a direction in which the roller pair conveys the sheet, and the sheet bundle processing device processes the sheet bundle including the sheet on which an image is formed.

This enables processing at a desired position in each sheet of the sheet bundle including a plurality of sheets in which an image is formed.

Tenth Aspect

In a tenth aspect, the image forming system includes an image forming apparatus such as the image forming apparatus 3 to form an image on a sheet and the sheet processing apparatus according to any one of the first aspect to the ninth aspect to process the sheet.

This enables suitable sheet bundle processing.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet processing apparatus comprising:

a roller pair configured to convey at least one sheet;

a first sheet conveyer configured to convey the at least one sheet to the roller pair; and circuitry configured to cause the first sheet conveyer to butt a leading edge of the at least one sheet to the roller pair, and cause the roller pair to begin rotating in reverse to align the leading edge of the at least one sheet after the leading edge of the at least one sheet butts the roller pair.

2. The sheet processing apparatus according to claim 1, wherein the circuitry is configured to change, according to a property of the at least one sheet, a reverse rotation amount of the roller pair by which the roller pair rotates in reverse to align the leading edge of the at least one sheet.

3. The sheet processing apparatus according to claim 2, wherein the property of the at least one sheet includes a thickness of the at least one sheet, and wherein the circuitry is configured to increase the reverse rotation based on the thickness of the at least one sheet.

4. The sheet processing apparatus according to claim 1, further comprising a second sheet conveyer configured to convey a following sheet subsequent to the at least one sheet, wherein the circuitry is configured to cause the second sheet conveyer to convey the following sheet such that a leading edge of the following sheet butts the roller pair aligning the leading edge of the following sheet and the leading edge of the at least one sheet.

5. The sheet processing apparatus according to claim 4, wherein the circuitry is configured to cause the roller pair to rotate in reverse to cause the leading edge of the following sheet to butt the roller pair.

6. The sheet processing apparatus according to claim 4, wherein, in response to a number of overlaid sheets reaching a set number, the circuitry is configured to cause the second sheet conveyer to convey the following sheet such that the leading edge of the following sheet butts the roller pair and the following sheet bends, cause the first sheet conveyer to convey the at least one sheet such that the leading edge of the at least one sheet butts the roller pair and the at least one sheet bends, and cause the roller pair to convey and overlay the following sheet and the at least one sheet.

7. The sheet processing apparatus according to claim 6, wherein the circuitry is configured to cause the roller pair to rotate in response to the following sheet being bent a set amount.

8. The sheet processing apparatus according to claim 4, wherein the second sheet conveyer includes a widened portion configured to allow a portion of the following sheet to bend at the widened portion.

9. The sheet processing apparatus according to claim 1, further comprising a sheet bundle processing device disposed downstream from the roller pair in the conveyance direction, wherein the sheet bundle processing device is configured to process the sheet bundle.

10. An image forming system comprising:

an image forming apparatus configured to form an image on a sheet; and the sheet processing apparatus according to claim 1.

11. The sheet processing apparatus according to claim 1, wherein the first sheet conveyer includes a widened portion configured to allow a portion of the at least one sheet to bend at the widened portion.

12. A sheet processing apparatus comprising:

a roller pair configured to convey at least one sheet;

a first sheet conveyer configured to convey the at least one sheet to the roller pair;

a second sheet conveyer configured to convey a following sheet subsequent to the at least one sheet; and circuitry configured to cause the first sheet conveyer to butt a leading edge of the at least one sheet to the roller pair, cause the roller pair to rotate in reverse to align the leading edge of the at least one sheet in response to the leading edge of the at least one sheet butting against the roller pair, and cause the second sheet conveyer to convey the following sheet such that a leading edge of the following sheet butts the roller pair aligning the leading edge of the following sheet and the leading edge of the at least one sheet.

13. The sheet processing apparatus according to claim 12, wherein the circuitry is configured to cause the roller pair to rotate in reverse to cause the leading edge of the following sheet to butt the roller pair.

14. The sheet processing apparatus according to claim 12, wherein, in response to a number of overlaid sheets reaching a set number, the circuitry is configured to cause the second sheet conveyer to convey the following sheet such that the leading edge of the following sheet butts the roller pair and the following sheet bends, cause the first sheet conveyer to convey the at least one sheet such that the leading edges of the at least one sheet butt the roller pair and the at least one sheet bends, and cause the roller pair to convey and overlay the following sheet and the at least one sheet.

15. The sheet processing apparatus according to claim 14, wherein the circuitry is configured to cause the roller pair to rotate in response to the following sheet being bent a set amount.

16. The sheet processing apparatus according to claim 12, further comprising a sheet bundle processing device disposed downstream from the roller pair in the conveyance direction, wherein the sheet bundle processing device is configured to process the sheet bundle.

17. An image forming system comprising:

an image forming apparatus configured to form an image on a sheet; and the sheet processing apparatus according to claim 12.

18. The sheet processing apparatus according to claim 12, wherein the first sheet conveyer includes a widened portion configured to allow a portion of the at least one sheet to bend at the widened portion.

19. The sheet processing apparatus according to claim 12, wherein the second sheet conveyer includes a widened portion configured to allow a portion of the following sheet to bend at the widened portion.

* * * * *